US010988290B2

(12) United States Patent
Danks et al.

(10) Patent No.: US 10,988,290 B2
(45) Date of Patent: Apr. 27, 2021

(54) LINER FOR A CONTAINER CLOSURE AND PACKAGE USING THE CLOSURE AND LINER

(71) Applicant: AptarGroup, Inc., Crystal Lake, IL (US)

(72) Inventors: Christopher Danks, Waukesha, WI (US); John Wisniewski, Wauwatosa, WI (US)

(73) Assignee: APTARGROUP, INC., Crystal Lake, IL (US)

( * ) Notice: Subject to any disclaimer, the term of this patent is extended or adjusted under 35 U.S.C. 154(b) by 85 days.

(21) Appl. No.: 16/603,727

(22) PCT Filed: Apr. 25, 2018

(86) PCT No.: PCT/US2018/029342

§ 371 (c)(1),
(2) Date: Oct. 8, 2019

(87) PCT Pub. No.: WO2018/200662

PCT Pub. Date: Nov. 1, 2018

(65) Prior Publication Data

US 2021/0094734 A1 Apr. 1, 2021

Related U.S. Application Data

(60) Provisional application No. 62/490,256, filed on Apr. 26, 2017.

(51) Int. Cl.
*B65D 51/14* (2006.01)
*B65D 47/20* (2006.01)
(Continued)

(52) U.S. Cl.
CPC ..... *B65D 51/14* (2013.01); *B65D 47/2031* (2013.01); *B65D 53/02* (2013.01);
(Continued)

(58) Field of Classification Search
CPC ..... B65D 51/20; B65D 51/145; B65D 51/14; B65D 47/2031; B65D 47/2018;
(Continued)

(56) References Cited

U.S. PATENT DOCUMENTS 4,359,169 A * 11/1982 Helms ..... B65D 51/20 220/255.1
4,397,401 A * 8/1983 Ueno ..... B29C 63/0082 156/69
(Continued)

OTHER PUBLICATIONS

International Search Report and Written Opinion from the U.S. acting as International Searching Authority for PCT/US2018/029342 of which this subject application is a U.S. National Stage.

*Primary Examiner* — Robert J Hicks
(74) *Attorney, Agent, or Firm* — Wood, Phillips, Katz, Clark & Mortimer

(57) ABSTRACT

A liner (100) and closure (106) are provided for being initially assembled and subsequently installed on a container (104) of a product to create a package (107, 107A). The liner (100) is provided for being disposed between, and sealed to, the container (104) and the closure (106) mounted thereon. The liner (100) includes a metallic substrate layer (200) that is an aluminum alloy and that is located between first and second heat-sealable layers (212, 200), respectively. The liner (100) has a through hole (252), and the metallic substrate layer (200) has a laterally inward edge surface (210) that is exposed at the through hole (252).

27 Claims, 10 Drawing Sheets

(51) Int. Cl.

| | |
|---|---|
| ***B65D 53/02*** | (2006.01) |
| ***B65D 85/84*** | (2006.01) |
| ***B65D 85/72*** | (2006.01) |
| ***B65D 53/10*** | (2006.01) |

(52) U.S. Cl.

CPC ..... *B65D 53/10* (2013.01); *B65D 85/72* (2013.01); *B65D 85/84* (2013.01); *B65D 2251/009* (2013.01); *B65D 2251/0025* (2013.01)

(58) Field of Classification Search

CPC ..... B65D 47/0838; B65D 55/16; B65D 77/2024; B65D 53/10; B65D 53/02; B65D 85/84; B65D 85/72; B65D 41/045; B65D 41/0435; B65D 43/162; B65D 43/164; B65D 43/16

USPC ..... 215/243, 237, 235, 232, 349, 341; 220/837, 836, 810, 359.4, 359.3, 359.1

See application file for complete search history.

(56) References Cited

U.S. PATENT DOCUMENTS

| | | | | |
|---|---|---|---|---|
| 4,727,999 | A * | 3/1988 | Gach | B65D 47/0885 215/232 |
| 4,758,456 | A * | 7/1988 | Muscala | B65D 55/0854 428/40.6 |
| 5,012,946 | A * | 5/1991 | McCarthy | B65D 51/20 215/232 |
| 5,513,781 | A * | 5/1996 | Ullrich | B65D 47/185 215/232 |
| 5,632,420 | A | 5/1997 | Lohrman et al. | |
| 6,082,568 | A * | 7/2000 | Flanagan | B65D 51/20 215/232 |
| 6,446,844 | B1 | 9/2002 | Gross | |
| 9,440,766 | B2 | 9/2016 | Wiening | |
| 2003/0196418 | A1 | 10/2003 | O'Brien et al. | |
| 2004/0094551 | A1 | 5/2004 | Mavin et al. | |
| 2007/0289936 | A1 * | 12/2007 | Pugne | B29C 45/1676 215/237 |
| 2009/0084814 | A1 | 4/2009 | Wisniewski et al. | |
| 2015/0233235 | A1 | 8/2015 | Li et al. | |

* cited by examiner

LINER FOR A CONTAINER CLOSURE AND PACKAGE USING THE CLOSURE AND LINER

CROSS-REFERENCE TO RELATED APPLICATION

This application claims priority to U.S. Patent Application No. 62/490,256, filed Apr. 26, 2017, which is incorporated by reference herein in its entirety.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

This invention relates to a liner for use with a container and a closure, to an assembly of a liner and closure, and to a package comprising a container of a product with the liner and closure installed thereon.

BACKGROUND OF THE INVENTION AND TECHNICAL PROBLEMS POSED BY THE PRIOR ART

Closures are employed to selectively prevent or permit communication between the exterior and interior of a system (e.g., machine, equipment, containment system (including bottles and pouches), etc.) through an opening in the system. A closure specifically designed for dispensing a fluent substance may be described as a dispensing closure. One type of closure includes at least (1) a receiving structure (e.g., a body, base, fitment, etc.) located at an opening to the system interior, and (2) a closing element (e.g., a lid, cover, overcap, pivotable disc top type actuator, etc.) that is cooperatively received by the receiving structure.

In one type of closure, the receiving structure is a separate structure that (a) can be attached at such a system opening, and (b) defines at least one access passage through the receiving structure for communicating through such a system opening with the interior of such a system.

The closing element is typically movable relative to the receiving structure access passage between (1) a fully closed position occluding the access passage, and (2) an open position at least partially exposing the access passage. Some closures may include additional elements (e.g., tamper-evident features, locking elements, etc.).

Some closures are specifically intended for being attached to an open end or mouth of a container that contains contents such as a product. In such a case, the closure, container, and product together define a "package". The product may be a fluent product, as well as a non-fluent product.

A container closure can be conveniently molded or otherwise manufactured from a suitable material (e.g., a thermoplastic material). Such a container closure typically has a receiving structure in the form of a hollow body that, when installed at the open end of the container, defines an opening ("access passage") through the body to the container interior. Such a closure typically includes a closing element in the form of a lid (which may or may not be hingedly mounted on the closure body) that can be lifted up or otherwise moved to provide communication through the closure body opening ("access passage") with the container open end and container interior.

For some types of products, it can be desirable to provide a closure that incorporates a valve in addition to, or as part of, a closing element. Such a valve typically has (1) a closed (typically unpressurized) condition for occluding the opening ("access passage") in the hollow closure body; and (2) an open (typically pressurized) condition for allowing product to be dispensed from, or accessed within, the container interior through the opening ("access passage") in the hollow closure body.

With some closures, a "liner" in the form of a disc of material may be disposed between, and bonded or otherwise attached to, both a portion of the closure receiving structure (e.g., body) and the upper end of the container across the container opening ("mouth") to provide a tamper-evident seal and/or a substantially permanent seal between the closure and the container. Such a seal may also prevent or minimize out-leakage of the product to the ambient environment or in-leakage from the ambient environment of atmospheric gases or other substances (which could be liquid, solid or gaseous contaminants). Some liners may be manufactured by providing a sheet of liner material having a metallic substrate layer, and punching or stamping the sheet of liner material to create a generally annular configuration or other configuration having a through hole that is defined by one or more cut edges that are exposed to the open interior of the container. Such exposed liner edges may come into contact with the contained product. The U.S. Pat. No. 8,573,423 discloses such a liner wherein the metallic substrate layer (e.g., aluminum foil) is sandwiched between, and attached to, two outer, heat-sealable thermoplastic layers. The metallic substrate layer of the liner functions to heat up in an induction heating system through which the assembly of the closure, liner, and top end of the container pass so as to fuse and heat seal (bond) each of the two, outer, heat-sealable layers to a respective one of the closure body and container.

Although a metallic layer is not required in a liner that is to be installed using other processes such as adhesive or conduction heat bonding (instead of induction heat sealing), such other bonding processes could be employed even with liners that have a metallic substrate layer (that in such an application would not serve an induction heating function). In any event, the inventors of the present invention note that if a liner with an exposed inner edge metallic substrate layer is used in a closure/container assembly, then the exposed metallic substrate layer edge could undesirably contact the contained product as explained below.

The inventors of the present invention note that a liner having a through hole with an exposed edge metal component (e.g., an aluminum substrate layer) could be used on a container of a product, and over time the metal could be oxidized or otherwise corroded by the product (e.g., an acidic or salty product (e.g., ketchup, salad dressing, etc.)). That could create undesirable reaction by-products or cause undesirable changes to the product (e.g., discoloration, taste changes, etc.) when the exposed metallic substrate layer edge interacts (e.g., reacts) with the product over time. Indeed, the inventors have noted that such a metallic substrate layer can become oxidized or otherwise corroded after contact with the product or with gases evaporating from the product. Such corrosion can result in a visually unappealing appearance, as well as other undesirable changes to the product, including changes in taste or other characteristics.

The inventors of the present invention have determined that it would be advantageous to provide an improved metallic substrate layer liner having a through hole defined by a cut edge, and a package using the improved liner, wherein the liner can be disposed between, and sealed to, a container and closure whereby the amount, if any, of the above-described undesirable reaction by-products and/or changes to certain products packaged within the container would be insufficient to be noticeable or objectionable to the user over the useful life of the package.

The inventors of the present invention have also noted that use of such heat-sealable liners having a metal component (e.g., aluminum) may allow the closure to be too easily removed completely from the container and allow undesirable access to the container interior through the open mouth of the container. For example, such a possibility of closure removal is not desirable with some packages wherein the closure closing element is openable to permit the dispensing of the product at only a low flow rate, and the package supplier does not want a user to be able to quickly remove a large quantity of the product from the package or refill the package. The inventors of the present invention have determined that in such applications, it would be advantageous to provide an improved liner, and a package using the improved liner, wherein the improved liner can be disposed between, and sealed to, a container and closure such that the closure could not be easily removed from the container without applying a very high removal torque to the closure and/or causing damage to the liner and/or closure and/or container.

Further, the inventors have determined that the use of such an improved liner should advantageously be readily employed with conventional container finishes (e.g., threads or snap fit beads) and conventional closure mating configurations so that the closure and/or container need not be manufactured with special structural features (e.g., anti-rotation abutments) that otherwise might be necessary to inhibit removal of the closure.

Additionally, the inventors have determined that it would be desirable to provide an improved heat-sealable liner, an assembly of the liner and closure, and a package using such an assembly so that the package could be made without requiring the application of such high amounts of induction energy that would damage or weaken the liner components in a way that would adversely affect the function of the liner and/or reduce the corrosion resistance of the liner's metal component.

The inventors have invented an improved, innovative liner and package using the improved liner, as well as an assembly of a closure and improved liner, wherein the liner can be installed with the closure on a container to provide a package which addresses the above-described problems, and which provides a solution not heretofore contemplated in the packaging industry or suggested by the prior art.

BRIEF SUMMARY OF THE INVENTION

According to some aspects of the present invention, an improved liner is provided for use in an improved package for a product. The package includes a product in a container and includes a closure installed with the improved liner on the container. The improved liner is disposed between, and sealed to, the container and the closure mounted on the container. The liner has a metallic substrate layer. The improved liner can eliminate, or at least reduce, some undesirable changes that could result from contact of the metallic substrate layer in a conventional liner with some products packaged in a container with a closure sealed thereto by such a conventional liner.

According to another aspect of the present invention, an improved assembly of the liner and a closure is provided for installation on a container of product to create a completed package.

In a first form of the invention, a package is provided and includes a container, a product in the container, a closure, and a liner. The container has (1) an interior and an opening to the container interior, and (2) a sealing surface around the opening to the container interior. The product is stored in the container interior. The closure is mounted on the container over the container opening. The closure has (1) an occludable access passage for preventing or permitting communication between the container interior and exterior, and (2) a sealing surface around the access passage. The liner is disposed at the container opening between the closure and the container. The liner has a through hole to accommodate communication through the access passage between the interior and exterior of the container. The liner also has a metallic substrate layer having (1) top and bottom surfaces, (2) a laterally inward edge surface that extends between the metallic substrate layer top and bottom surfaces and that is exposed at the liner through hole, and (3) a composition comprising an aluminum alloy wherein the aluminum alloy to the naked eye exhibits substantially no visible corrosion on the top surface after exposure of the laterally inward edge surface for five months to ketchup initially having a pH of about 4 and a sodium concentration of about 1% by weight at a temperature of 36.7 degrees Celsius. The liner also has a first heat-sealable layer that (1) is attached to the top surface of the metallic substrate layer, and (2) has a closure sealing surface heat-sealed to the sealing surface of the closure. The liner also has a second heat-sealable layer that (1) is attached to the bottom surface of the metallic substrate layer, and (2) has a container sealing surface heat-sealed to the sealing surface of the container.

In a second form of the invention, a package is provided and includes a container, a product in the container, a closure, and a liner. The container has (1) an interior and an opening to the container interior, and (2) a sealing surface around the opening to the container interior. The product is stored in the container interior. The closure is mounted on the container over the container opening. The closure has (1) an occludable access passage for preventing or permitting communication between the container interior and exterior, and (2) a sealing surface around the access passage. The liner is disposed at the container opening between the closure and the container. The liner has a through hole to accommodate communication through the access passage between the interior and exterior of the container. The liner also has a metallic substrate layer having (1) top and bottom surfaces, (2) a laterally inward edge surface that extends between the metallic substrate layer top and bottom surfaces and that is exposed at the liner through hole, and (3) a composition comprising an aluminum alloy wherein the aluminum alloy to the naked eye exhibits substantially no visible corrosion on the top surface after exposure of the laterally inward edge surface for five months to ketchup initially having a pH of about 4 and a sodium concentration of about 1% by weight at a temperature of 36.7 degrees Celsius. The liner also has a first heat-sealable layer that (1) is attached to the top surface of the metallic substrate layer, and (2) has a closure sealing surface heat-sealed to the sealing surface of the closure. The liner also has a second heat-sealable layer that (1) is attached to the bottom surface of the metallic substrate layer, and (2) has a container sealing surface heat-sealed to the sealing surface of the container. The liner is located relative to the closure and container such that the through hole is free of any internally projecting structure of the closure.

In a third form of the invention, a package is provided and includes a container, a product in the container, a closure, and a liner. The container has (1) an interior and an opening to the container interior, and (2) a sealing surface around the opening to the container interior. The product is stored in the container interior. The closure is mounted on the container over the container opening. The closure has (1) an occludable access passage for preventing or permitting communication between the container interior and exterior, and (2) a sealing surface around the access passage. The liner is disposed at the container opening between the closure and the container. The liner has a through hole to accommodate communication through the access passage between the interior and exterior of the container. The liner also has a metallic substrate layer having (1) top and bottom surfaces, (2) a laterally inward edge surface that extends between the metallic substrate layer top and bottom surfaces and that is exposed at the liner through hole, and (3) a composition comprising an aluminum alloy wherein the aluminum alloy to the naked eye exhibits substantially no visible corrosion on the top surface after exposure of the laterally inward edge surface for five months to ketchup initially having a pH of about 4 and a sodium concentration of about 1% by weight at a temperature of 36.7 degrees Celsius. The liner also has a first heat-sealable layer that (1) is attached to the top surface of the metallic substrate layer, and (2) has a closure sealing surface heat-sealed to the sealing surface of the closure. The liner also has a second heat-sealable layer that (1) is attached to the bottom surface of the metallic substrate layer, and (2) has a container sealing surface heat-sealed to the sealing surface of the container wherein each said first heat-sealable layer and said second heat-sealable layer is heat-sealed to create a bond which is sufficiently strong such that a torque greater than 8.47 Newton-meters is required to initially effect relative rotation between said closure and the container for destroying the heat-sealed installation and permit removal of said closure.

In a fourth form of the invention, a package is provided and includes a container, a product in the container, a closure, and a liner. The container has (1) an interior and an opening to the container interior, and (2) a sealing surface around the opening to the container interior. The product is stored in the container interior. The closure is mounted on the container over the container opening. The closure has (1) an occludable access passage for preventing or permitting communication between the container interior and exterior, and (2) a sealing surface around the access passage. The liner is disposed at the container opening between the closure and the container. The liner has a through hole to accommodate communication through the access passage between the interior and exterior of the container. The liner also has a metallic substrate layer having (1) top and bottom surfaces, (2) a laterally inward edge surface that extends between the metallic substrate layer top and bottom surfaces and that is exposed at the liner through hole, and (3) a composition comprising an aluminum alloy wherein the aluminum alloy to the naked eye exhibits substantially no visible corrosion on the top surface after exposure of the laterally inward edge surface for five months to a product initially having a pH of about 4 at a temperature of 36.7 degrees Celsius. The liner also has a first heat-sealable layer that (1) is attached to the top surface of the metallic substrate layer, and (2) has a closure sealing surface heat-sealed to the sealing surface of the closure. The liner also has a second heat-sealable layer that (1) is attached to the bottom surface of the metallic substrate layer, and (2) has a container sealing surface heat-sealed to the sealing surface of the container.

In a fifth form of the invention, a package is provided and includes a container, a product in the container, a closure, and a liner. The container has (1) an interior and an opening to the container interior, and (2) a sealing surface around the opening to the container interior. The product is stored in the container interior. The closure is mounted on the container over the container opening. The closure has (1) an occludable access passage for preventing or permitting communication between the container interior and exterior, and (2) a sealing surface around the access passage. The liner is disposed at the container opening between the closure and the container. The liner has a through hole to accommodate communication through the access passage between the interior and exterior of the container. The liner also has a metallic substrate layer having (1) top and bottom surfaces, (2) a laterally inward edge surface that extends between the metallic substrate layer top and bottom surfaces and that is exposed at the liner through hole, and (3) a composition comprising an aluminum alloy wherein the aluminum alloy to the naked eye exhibits substantially no visible corrosion in excess of about 0.1% of the area of the top surface after exposure of said laterally inward edge surface for five months to a product initially having a pH of about 4 at a temperature of 36.7 degrees Celsius. The liner also has a first heat-sealable layer that (1) is attached to the top surface of the metallic substrate layer, and (2) has a closure sealing surface heat-sealed to the sealing surface of the closure. The liner also has a second heat-sealable layer that (1) is attached to the bottom surface of the metallic substrate layer, and (2) has a container sealing surface heat-sealed to the sealing surface of the container.

In a sixth form of the invention, a liner is provided for use in a package wherein the package includes a container, a product in the container, a closure, and the liner. The container has (1) an interior and an opening to the container interior, and (2) a sealing surface around the opening to the container interior. The product is stored in the container interior. The closure is mounted on the container over the container opening. The closure has (1) an occludable access passage for preventing or permitting communication between the container interior and exterior, and (2) a sealing surface around the access passage. When installed in the package, the liner is disposed at the container opening between the closure and the container. The liner, prior to installation in the package, has a configuration that defines a through hole to accommodate communication through the access passage between the interior and exterior of the container when the liner is subsequently installed in the package. The liner also has a metallic substrate layer having (1) top and bottom surfaces, (2) a laterally inward edge surface that extends between the metallic substrate layer top and bottom surfaces and that is exposed at the liner through hole, and (3) a composition comprising an aluminum alloy wherein the aluminum alloy to the naked eye exhibits substantially no visible corrosion on the top surface after exposure of the laterally inward edge surface for five months to a product initially having a pH of about 4 at a temperature of 36.7 degrees Celsius. The liner also has a first heat-sealable layer that (1) is attached to the top surface of the metallic substrate layer, and (2) has a closure sealing surface that can be heat-sealed to the sealing surface of the closure. The liner also has a second heat-sealable layer that (1) is attached to the bottom surface of the metallic substrate layer, and (2) has a container sealing surface that can be heat-sealed to the sealing surface of the container.

In a seventh form of the invention, a liner is provided for use in a package wherein the package includes a container, a product in the container, a closure, and the liner. The container has (1) an interior and an opening to the container interior, and (2) a sealing surface around the opening to the container interior. The product is stored in the container interior. The closure is mounted on the container over the container opening. The closure has (1) an occludable access passage for preventing or permitting communication between the container interior and exterior, and (2) a sealing surface around the access passage. When installed in the package, the liner is disposed at the container opening between the closure and the container. The liner, prior to installation in the package, has a configuration that defines a through hole to accommodate communication through the access passage between the interior and exterior of the container when the liner is subsequently installed in the package. The liner also has a metallic substrate layer having (1) top and bottom surfaces, (2) a laterally inward edge surface that extends between the metallic substrate layer top and bottom surfaces and that is exposed at the liner through hole, and (3) a composition comprising an aluminum alloy wherein the aluminum alloy to the naked eye exhibits substantially no visible corrosion in excess of about 0.1% of the area of the top surface after exposure of the laterally inward edge surface for five months to a product initially having a pH of about 4 at a temperature of 36.7 degrees Celsius. The liner also has a first heat-sealable layer that (1) is attached to the top surface of the metallic substrate layer, and (2) has a closure sealing surface that can be heat-sealed to the sealing surface of the closure. The liner also has a second heat-sealable layer that (1) is attached to the bottom surface of the metallic substrate layer, and (2) has a container sealing surface that can be heat-sealed to the sealing surface of the container.

In an eighth form of the invention, an assembly of a liner and closure is provided for subsequent installation as part of a package wherein the package includes a container, a product in the container, a closure, and a liner. The container has (1) an interior and an opening to the container interior, and (2) a sealing surface around the opening to the container interior. The product is stored in the container interior. The assembly comprises the closure and liner. The closure is provided for being mounted on the container over the container opening. The closure has (1) an occludable access passage for preventing or permitting communication between the container interior and exterior, and (2) a sealing surface around the access passage. The liner has a periphery that engages the closure so as to retain the liner in the closure prior to installation in the package. The liner has a through hole to accommodate communication through the access passage between the interior and exterior of the container. The liner also has a metallic substrate layer having (1) top and bottom surfaces, (2) a laterally inward edge surface that extends between the metallic substrate layer top and bottom surfaces and that is exposed at the liner through hole, and (3) a composition comprising an aluminum alloy wherein the aluminum alloy to the naked eye exhibits substantially no visible corrosion in excess of about 0.1% of the area of the top surface after exposure of the laterally inward edge surface for five months to a product initially having a pH of about 4 at a temperature of 36.7 degrees Celsius. The liner also has a first heat-sealable layer that (1) is attached to the top surface of the metallic substrate layer, and (2) has a closure sealing surface that can be heat-sealed to the sealing surface of the closure. The liner also has a second heat-sealable layer that (1) is attached to the bottom surface of the metallic substrate layer, and (2) has a container sealing surface that can be heat-sealed to the sealing surface of the container. The liner has a position in the closure that locates the liner through hole in the closure access passage so that the through hole is free of any internally projecting structure of the closure.

According to one presently preferred position of each of the above-described forms of the inventive article, one or both of the liner heat-sealable layers are about 0.25 millimeters thick.

According to one presently preferred composition of each of the above-described forms of the inventive article, the liner metallic substrate layer is about 0.05 millimeters thick.

According to one presently preferred composition of each of the above-described forms of an inventive article, the liner first and second heat-sealable layers are each formed from a different material. For example, one of the layers could be polyethylene terephthalate, and the other layer could be polypropylene.

In each of the above-described forms of the inventive article, at least one of the first heat-sealable layer and second heat-sealable layer may be formed from a plurality of thinner layers.

According to one presently preferred composition of each of the above-described fourth, fifth, sixth, seventh, and eighth forms of the inventive articles, the liner metallic substrate layer composition comprises an aluminum alloy wherein the aluminum alloy to the naked eye exhibits no visible corrosion on the top surface of the liner metallic substrate layer after exposure of the laterally inward edge surface for five months to ketchup initially having a pH of about 4 and a sodium concentration of about 1% by weight at a temperature of 36.7 degrees Celsius.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same:

FIG. 3 shows one embodiment of a liner of the present invention;

DESCRIPTION OF THE PREFERRED EMBODIMENTS

While this invention is susceptible of embodiment in many different forms, this specification and the accompanying drawings disclose only some specific forms (embodiments) as examples of the invention. However, the invention is not intended to be limited to the embodiments so described.

For ease of description, the package, liner, and liner/closure assembly of this invention are described in an orientation that they could have when the liner is installed on an upper end of a container and underneath a closure mounted on the container, and the container is stored upright on its bottom or base. It will be understood, however, that the package and liner of this invention may be manufactured, stored, transported, used, and sold in orientations other than those shown.

The liner of this invention is suitable for use with a variety of conventional or special systems or containers having various designs, the details of which, although not illustrated or described, would be apparent to those having skill in the art and an understanding of such containers.

In some of the Figures, the liner is shown in a simplified manner for ease of illustration, wherein the liner is shown with a metallic substrate layer between by a pair of heat-sealable layers. The layers form a laminate structure wherein the layers can be bonded together by suitable means, including thin film adhesive layers which are visible in some, but not all, of the Figures. Further, it will be understood that the each of the metallic substrate layer and/or the heat-sealable layers can be composed of a plurality of thinner layers (i.e., a plurality of thinner strata, sub-layers, or laminae). For example, while the inventive liner is depicted as including each heat-sealable layer in the form of a monolithic polymer layer, it will be understood that each such heat-sealable layer itself could be composed of a plurality of thinner layers (i.e., thinner strata, laminae, or sub-layers) made from a variety of materials (e.g., polymers, adhesives, etc.) wherein at least the outermost surface material is heat-sealable.

Figure 1:
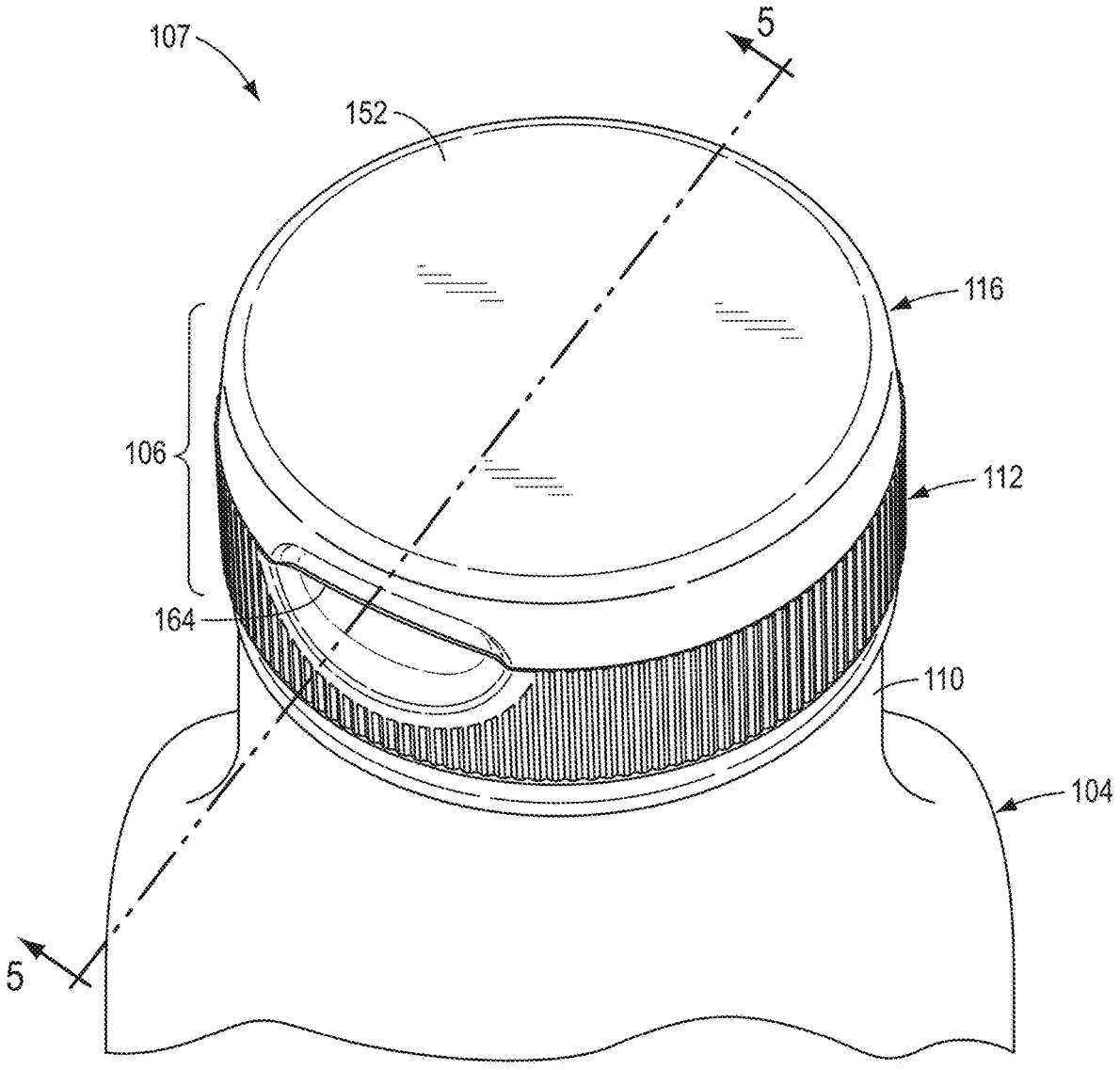
FIG. 1 is a fragmentary, perspective view, taken from above, of a package that includes a container, the container contents (i.e., a product not visible in FIG. 1), a closure mounted on the container, a liner (not visible in FIG. 1) sealed to, and between, the closure and the container, and a valve (not visible in FIG. 1) retained in the closure by a valve retainer (not visible in FIG. 1)

One presently preferred embodiment of a liner of the present invention is illustrated in FIGS. 3-8 where it is designated generally therein by reference number 100. This embodiment of the liner 100 is initially provided as a separately manufactured article for being heat sealed, or otherwise mounted, between a containment system (e.g., a bottle or container 104), and a cap or closure 106. The assembly of the liner 100, container 104 filled with product, closure 106, and other optional closure components that may be provided (e.g., a valve and valve retainer as discussed herein) is referred to generally herein as a "package" 107 (FIG. 1) which would be typically encountered by a customer or other user.

The container 104 typically has an upper end defining a mouth or open end 108 (FIG. 3) which provides access to the container interior where the contents, such as a product, may be contained. The product is not visible in the Figures. The product may be, for example, ketchup, mustard, etc., which can be dispensed or poured from a container by upending the container or pressurizing a portion of the container. The product may also be a less fluent material that can be stirred or removed with a cannula or utensil, and such products can include powders, slurries, particles, articles, etc. Such materials may be sold, for example, as a food product, a personal care product, an industrial or household product, or other substance (e.g., for internal or external use by humans or animals, or for use in activities involving medicine, manufacturing, commercial or household maintenance, construction, agriculture, etc.).

Figure 3:
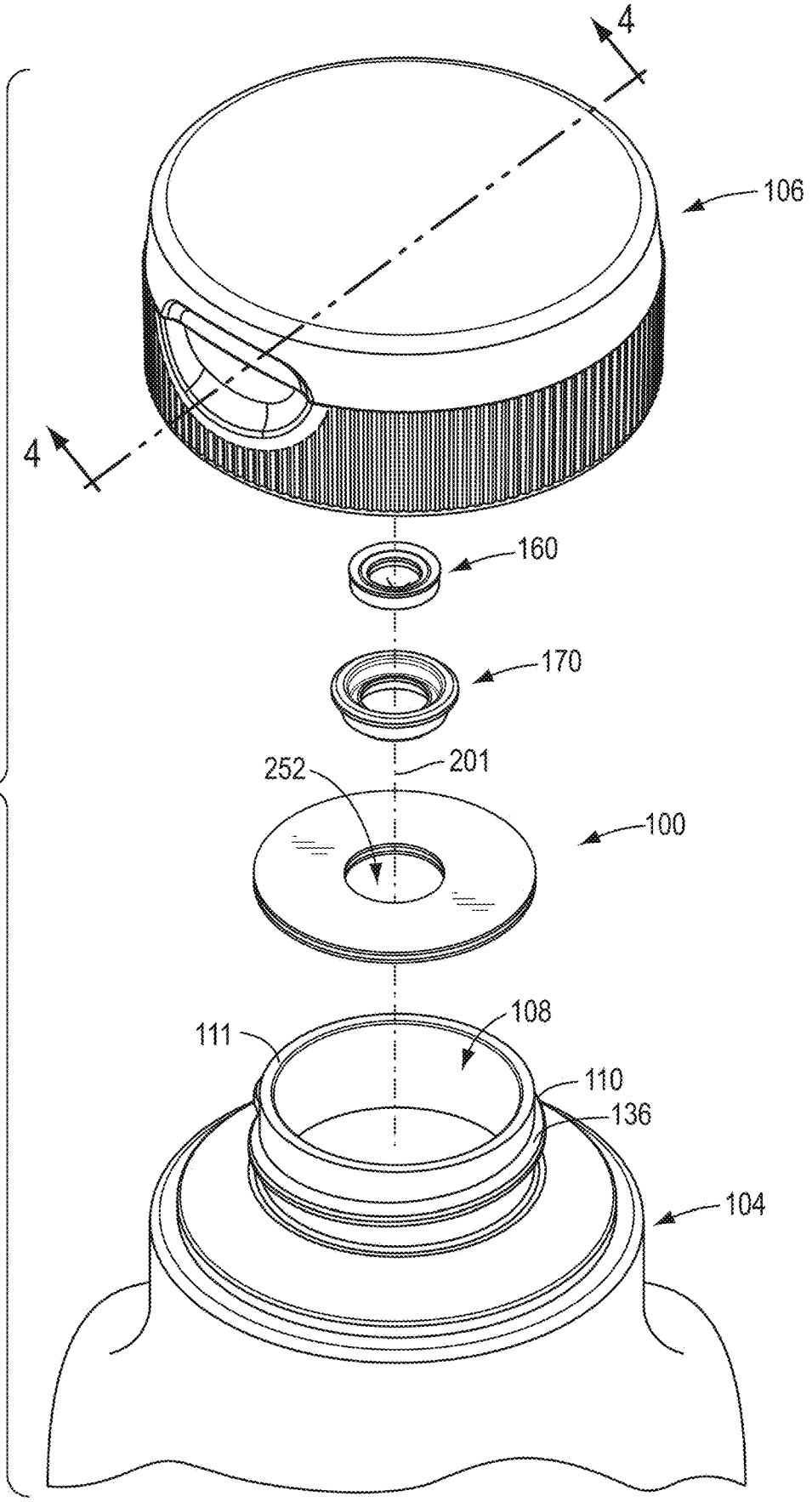
FIG. 3 is a fragmentary, perspective, exploded view of the package shown in FIG. 1.

The particular illustrated container 104 has a reduced size upper portion or neck 110 with an upper end defining a flat, annular sealing surface 111. However, if desired, the upper end of the container 104 need not have a discernible neck 110 and may have other suitable structures that define the container upper open end or opening 108 (FIG. 3) with a cross-sectional configuration with which the closure 106 is adapted to engage. Although not illustrated, the body of the container 104 below the neck 110 may have a cross-sectional configuration that is uniform with the cross-sectional configuration of the container opening 108. On the other hand, as is the case with the illustrated container 104, the container 104 may have a non-uniform shape along some of its length or height, with a neck 110 of any significantly reduced size or significantly different cross-section. As can be seen in FIG. 3, the neck 110 includes an external thread 136 for engaging a mating thread 132 (FIG. 5) on the inside of the closure 106 as discussed hereinafter.

The container 104 may or may not be a squeezable container having a flexible, resilient wall or walls which can be grasped by the user and compressed somewhat (i.e., temporarily, elastically deformed). The illustrated embodiment of the liner 100 is especially suitable for use with a container 104 having a wall that is intended to be temporarily squeezed inwardly by the user. The closure 106 used with the inventive liner 100 is illustrated as having a generally cylindrical shape; however, it will be appreciated that the shape of the liner 100 may be altered for use with closures that have a variety of shapes such as polygonal or irregular shapes, depending on the functional or aesthetic design of the package into which the liner 100 will be incorporated.

Figure 2:
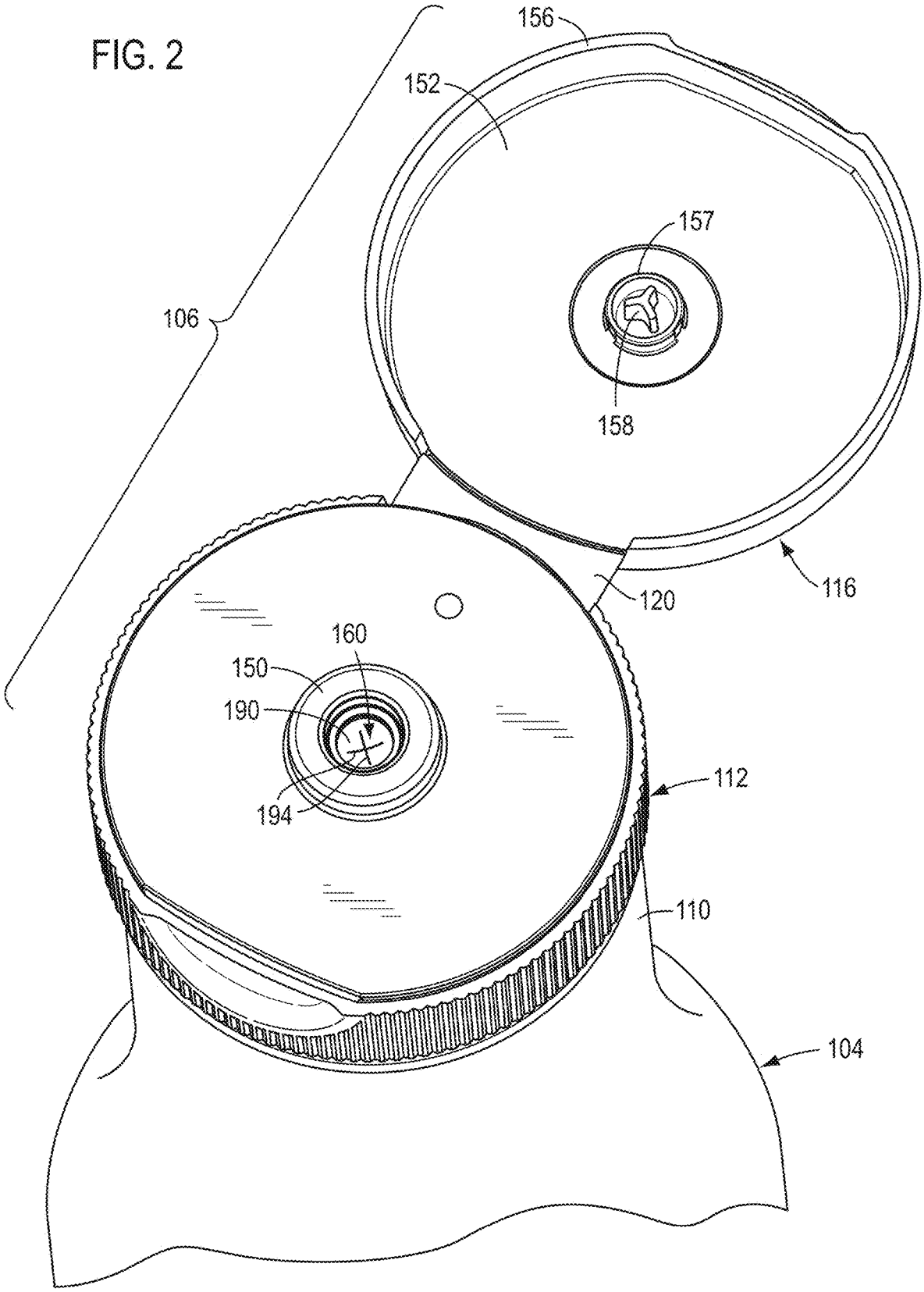
FIG. 2 is a fragmentary, perspective view taken from above of the package shown in FIG. 1, but in FIG. 2 the lid of the closure has been moved from a closed position to an open position allowing access to the container interior.

With reference to FIG. 2, the illustrated closure 106 comprises a body or base 112 (i.e., a base peripheral wall or other peripheral structure) and a lid 116 (i.e., closing element, top, or cover) joined to the base 112 by a hinge 120. The closure base 112, lid 116, and hinge 120 can be readily molded together as a unitary structure in an open condition from a suitable thermoplastic material such as polyethylene, polypropylene or the like. Other materials may be employed instead.

Figure 4:
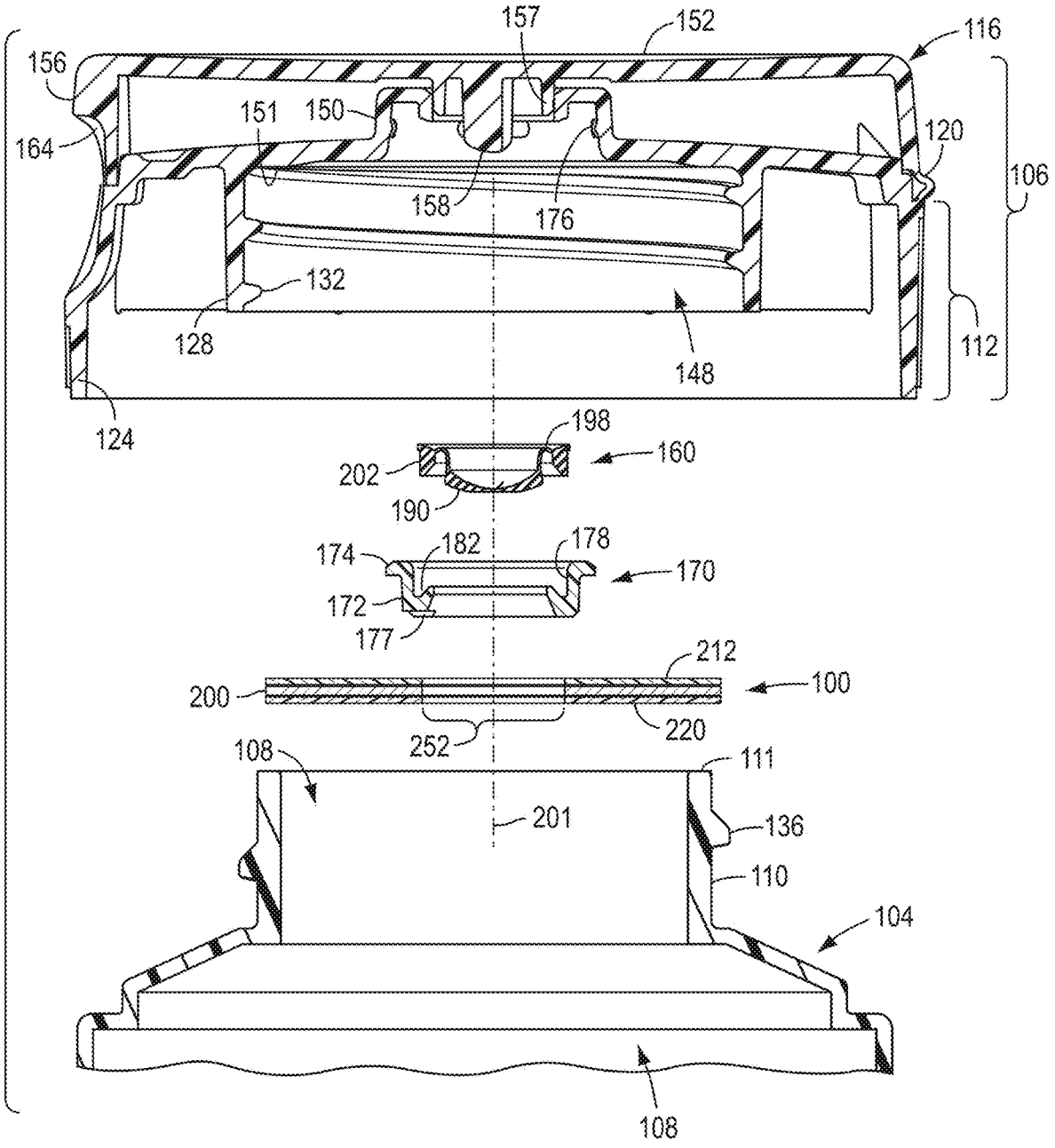
FIG. 4 is and enlarged fragmentary, exploded, cross-sectional view of the package taken along the plane 4-4 in FIG. 3.
Figure 5:
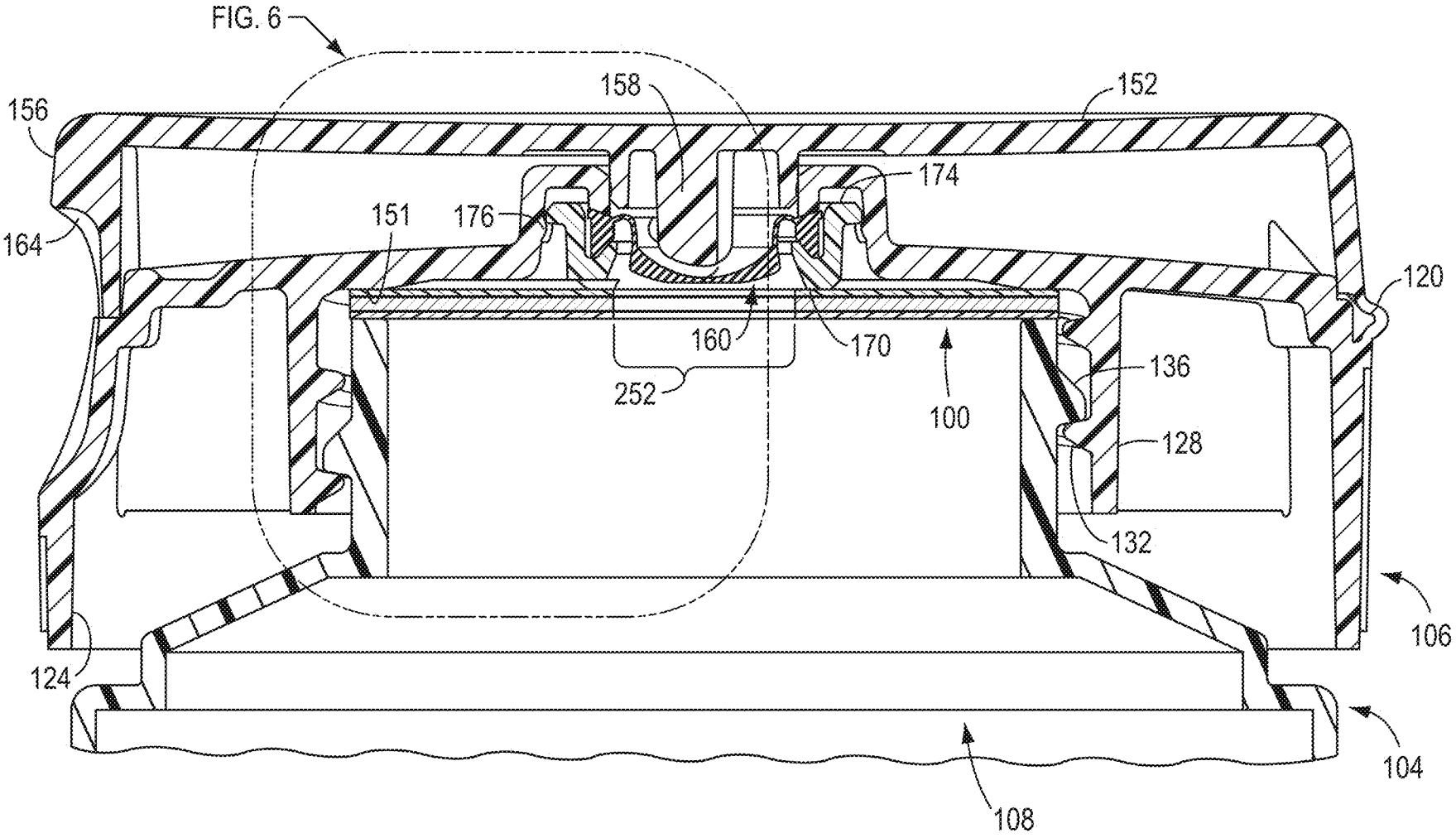
FIG. 5 is a fragmentary, cross-sectional view of the package taken along the plane 5-5 in FIG. 1.

The closure 106 is initially molded as a completely separate article that is subsequently attached to the container 104 with the liner 100 after the container 104 has been initially filled with a product. The closure base 112 has a depending, peripheral, outer skirt 124 (FIG. 4) for surrounding the container neck 110. As can be seen in FIGS. 4 and 5, the closure base 112 also includes a downwardly depending inner skirt 128 (FIG. 4) with the internal thread 132 for threading engagement with the external thread 136 on the neck 110 of the container 104 so as to secure the closure base 112 to the container 104. The threads 132 and 136 may have any suitable conventional or special thread forms. The thread 132 could be replaced by a conventional snap-fit bead (not illustrated) for engaging a mating bead (not illustrated)

on the container neck 110 instead of the container thread 136. Other forms of attaching the closure base 112 to the container 104 could be used. Also, in some applications, only the liner 100 could be used to attach the closure base 112 to the container 104, and the threaded attachment (or other attachment) could be eliminated.

The closure base 112 has an opening or access passage 148 (FIG. 4) that permits communication between the container interior and the exterior when the lid 116 is open. The access passage 148 accommodates the flow of product through the closure 106 from the interior of the container 104. The access passage 148 extends through a spout 150 (FIG. 4) that extends outwardly from the top of the base 112 (FIG. 4). The access passage 148 is covered by the lid 116 when the lid 116 is in a closed position. The access passage 148 is thus selectively occludable for selectively preventing or permitting communication between the container interior and exterior.

The closure base 112 also defines an annular sealing surface 151 (FIGS. 4 and 5) around the access passage 148 for accommodating the sealing of the closure 106 to the container 104 as discussed in detail hereinafter.

Referring to FIGS. 2 and 4, the lid 116 includes a top deck or cover portion 152 substantially surrounded by an outer peripheral flange 156. An inner plug seal flange 157 projects from the underside of the cover portion 152 to sealingly engage the inside of the spout 150 when the lid 116 is closed. A valve abutment, or spud, 158 projects from the underside of the lid cover portion 152 to inhibit opening of a valve 160 (discussed in detail herein below) when the lid 116 is closed (FIG. 5). The spud 158 prevents the valve 160 from opening under the closed lid 116 if the interior of the container 104 is pressurized due to impacts, processing, or changes in temperature or atmospheric pressure.

The hinge 120, which connects the lid 116 to the base 112 of the closure 106, is molded unitarily together with the lid 116 and the base 112 near the top of the base peripheral skirt 124 (FIG. 4) so as to accommodate movement of the lid 116 between the open position exposing the access passage 148, and the closed position occluding the access passage 148.

With reference to FIG. 2, the hinge 120 may be of any suitable conventional or special design. For example, the hinge 120 illustrated in the Figures may be of a conventional snap-action type such as described in the U.S. Pat. Nos. 5,356,017 or 5,642,824, the details of which form no part of the present invention. The hinge 120 could also be a non-snap-action type, including a strap or tether. Preferably, the hinge 120 is molded unitarily with the base 112 and lid 116. However, in another embodiment (not illustrated), the hinge 120 may be omitted entirely, and the lid 116 can be completely separate, and completely removable, from the closure body or base 112. In such a case, the lid 116 could be a screw-on or snap-on type, for example. In some applications, the lid 116 could be omitted altogether.

A front portion of the closure lid 116 has a recess or lid lift 164 (FIG. 4) for engagement by a consumer or other user of the package. To open the lid 116, the user pulls outwardly and upwardly with a thumb or finger on the bottom of the lid lift 164 to disengage the inner plug seal flange 157 from access passage 148 in the spout 150 of the base 112. Other conventional or special designs could be used instead to retain the lid 116 on the base 112, such as some other types of interference fit or such as a latch (not illustrated).

With reference to FIG. 4, the closure 106 has a snap ring or retainer 170 for retaining the valve 160 in the closure base 112 across the access passage 148. The retainer 170 has an exterior surface 172 with a radially outwardly extending flange 174 (FIG. 6) for engaging a snap bead 176 in the closure base 112 to retain the retainer 170 in the closure base 112. The bottom of the retainer 170 has a recess 177 (FIG. 4) to accommodate the gate during molding or provide a recessed flat area into which the mold cavity number is molded for manufacturing identification purposes.

Figure 6:
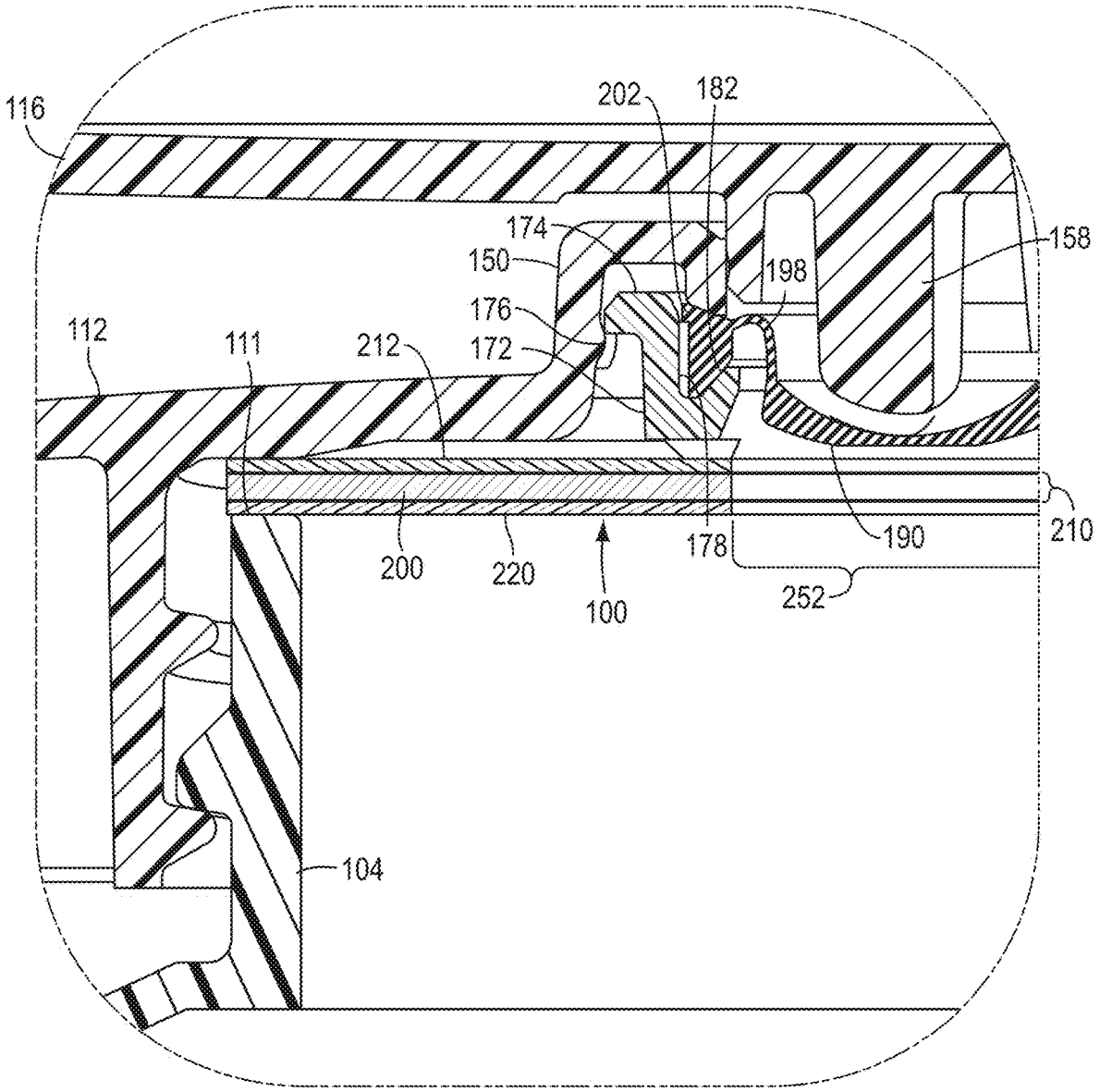
FIG. 6 is an enlarged, fragmentary, cross-sectional view of an interior portion of the package enclosed in the circumscribed area designated as "FIG. 6" in FIG. 5.

The retainer 170 further has an interior recess surface 178 (FIG. 6) and a radially inwardly extending projection or valve seat 182. As can be seen in FIG. 6, the valve seat 182 is generally frustoconical for confronting a peripheral mounting flange portion of the valve 160 when the valve 160 is installed in the closure 106 between the retainer 170 and the closure base 112, as will be discussed in detail herein.

While the retainer 170 is illustrated as having a generally hollow, cylindrical shape with an axially outward open end (i.e., top end) and an axially inward open end (i.e., bottom end), it will be appreciated that the retainer 170 may have a variety of shapes, such as polygonal or an irregularly shaped hollow body, depending on a number of design choices, such as the size and shape of the container 104, the closure 106, the liner 100, the valve 160, and/or other optional functional or aesthetic features of the package components.

As can best be seen in FIGS. 3-6, the closure valve 160 is a flexible, resilient, and self-sealing valve of a type that is commercially available. Such a valve is substantially disclosed in U.S. Pat. No. 5,676,289 with reference to the valve 46 identified in U.S. Pat. No. 5,676,289. The operation of such a type of valve is further described with reference to the similar valve that is designated by reference number 3d in U.S. Pat. No. 5,409,144. The descriptions of those two patents are incorporated herein by reference thereto to the extent pertinent and to the extent not inconsistent herewith. Such a valve, when subjected to a pressure differential acting across it in the closed condition, changes configuration between: (1) the closed condition (i.e., an as-molded, closed, unpressurized condition); and (2) an open, pressurized condition (not illustrated) wherein a substance (e.g., a product to be dispensed) may move through the valve 160. The valve 160 is preferably molded as a unitary structure from a material which is flexible, elastic, and resilient, such as silicone rubber, or other elastomers.

The valve 160 includes a flexible, central portion or head 190 (FIG. 6). When the valve 160 is in an as-molded, closed, and unpressurized condition, the head 190 has a generally concave configuration when viewed from the exterior of the top of the closure when the lid 116 is open (FIG. 2). As can be seen in FIG. 2, the valve head 190 has two intersecting, perpendicular, dispensing slits 194 that define four petals or flaps in the valve head 190. The flaps open outwardly (not illustrated) from the intersection of the slits 194 in response to an increasing pressure differential across the valve 160, as is generally described in U.S. Pat. No. 5,409,144. The slits 194 could be molded with the valve head 190, or they may be cut into the valve head 190 in a secondary manufacturing process. It will be understood that the valve 160 may have one or more dispensing orifices defined by structures other than slits 194, such as apertures or slits of different shapes, sizes, numbers, or configurations depending on the nature of the product within the container 104 and uses of the product.

Referring to FIG. 6, the valve 160 has a peripheral skirt or sleeve 198 connected to the valve head 190. At the radially outward end of the sleeve 198, the valve 160 has a peripheral flange or mounting portion 202 for being engaged between: (1) the valve seat 182 of the retainer 170, and (2) the underside of the closure base 112. The mounting portion 202 of the valve 160 has a generally dove-tailed shaped, transverse cross-section. The valve mounting portion 202 is preferably compressed or clamped between the valve seat 182 of the retainer 170 and the underside of the closure base 112 within the spout 150.

In some applications, the valve 160 or other type of slit valve could accommodate insertion of a cannula or other instrument to withdraw (or deposit) a product from (or into) the package. In some applications, the valve 160 and retainer 170 may be omitted altogether.

Referring to FIGS. 3-8, the liner 100, which may also be referred to as a seal or membrane, is provided between the container 104 and the closure 106 for tamper prevention (i.e., inhibiting the disassembly of the package) and/or to provide an enhanced leak-tight seal between the closure base 112 and the container upper end 111 as discussed in detail hereinafter.

Figure 7:
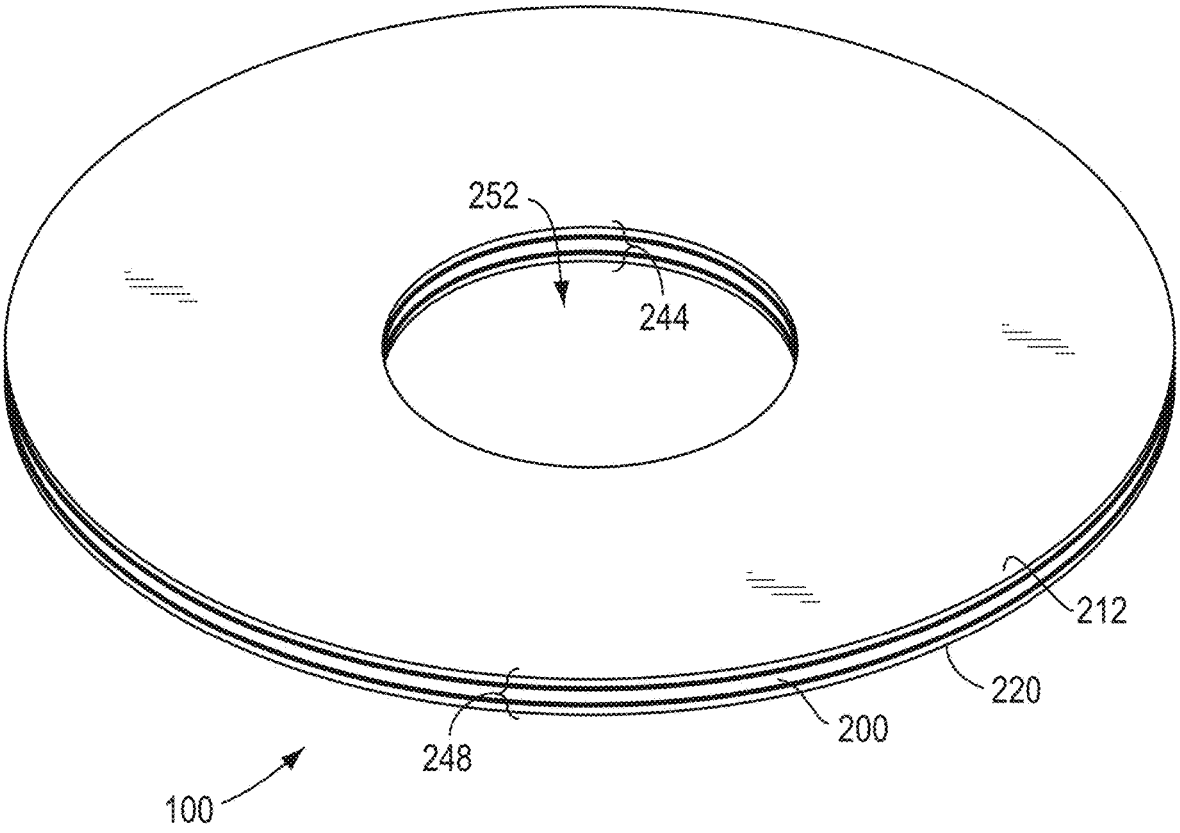
FIG. 7 is a greatly enlarged, perspective view taken from above of only the liner shown in FIG. 3.
Figure 8:
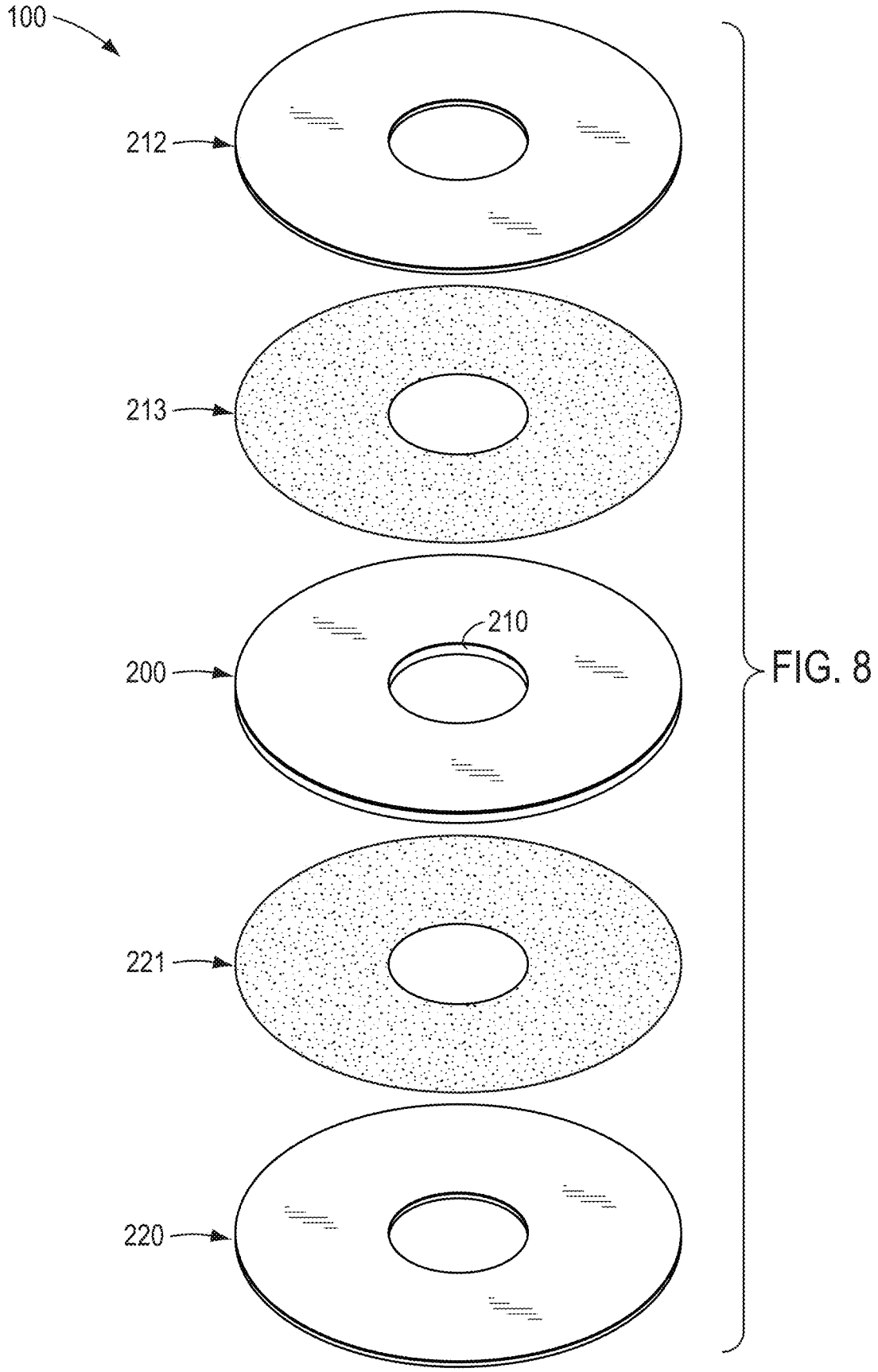
FIG. 8 is an exploded perspective view of components of the liner shown in FIG. 7.

As best seen in FIGS. 7 and 8, a presently preferred embodiment of the liner 100 of the present invention is formed as a composite, comprising a plurality of layers of different materials. One layer is a metallic substrate layer 200 that is made from a foil sheet of aluminum. The metallic substrate layer 200 defines top and bottom surfaces and a first laterally inward edge surface 210 (FIG. 8) defining a through hole which, in the preferred liner embodiment shown in FIG. 7, defines part of the height of a circular through hole 252 completely through the liner 100. As shown in FIG. 3, the liner hole 252 has its center in registry with an associated central axis 201. The package 107 may be stored and used in an orientation that is inverted (i.e., upside down) compared to the orientation shown in FIG. 1, but the top and bottom surfaces of the metallic substrate layer 200 are defined with reference to the upright orientation shown in FIG. 1 and the other Figures.

The liner 100 is further provided with a pair of heat-sealable layers—a first heat sealable layer 212 and a second heat-sealable layer 220—each formed from a thermoplastic polymer or polymers that are attached to the metallic substrate layer 200 and which can be heat sealed to the container upper end sealing surface 111 and also to the underside of the closure base 112 by induction heating which causes the metallic substrate layer 200 to heat up and conduct the heat into the adjacent heat-sealable layers 212 and 220.

Specifically, in one form of the liner 100, the first heat-sealable layer 212 is selected from a material that is either (1) the same material as closure base 112, or (2) a different material that is otherwise heat-sealably compatible with the closure base material. The first heat-sealable layer 212 may be, for example, polypropylene or polyethylene or polyethylene terephthalate that has been adhered to the first side surface 204 of the metallic substrate layer 200 with an adhesive layer 213 (FIG. 8), such as a thin film of adhesive, to adhesively laminate a sheet or web of the material (e.g., polypropylene or polyethylene or polyethylene terephthalate) to the top surface of the sheet of aluminum foil used for the metallic substrate layer 200. The top surface of the first heat-sealable layer 212 defines a closure sealing surface that can be heat sealed to the annular sealing surface 151 of the closure 106 so as to form a tamper-resistant bond and/or tamper-evident bond and/or leak-tight seal with the closure 106. In one presently preferred embodiment, the first heat-sealable layer 212 is a 0.0254-millimeter-thick layer of polypropylene.

Likewise, the second heat-sealable layer 220 is selected from a material that is either (1) the same material as the container upper end sealing surface 111, or (2) a different material that is otherwise heat-sealably compatible with the container upper end sealing surface 111. The second heat-sealable layer 220 may be, for example, polyethylene or polypropylene or polyethylene terephthalate that has been adhered to the bottom surface of the metallic substrate layer 200 with an adhesive layer 221 (FIG. 8), such as a thin film of adhesive to adhesively laminate a sheet or web of the material (e.g., polyethylene or polypropylene or polyethylene terephthalate) to the bottom surface of the sheet of aluminum foil used for the metallic substrate layer 200. The bottom surface of the second heat-sealable layer 220 defines a container sealing surface that can be heat sealed to the container upper end sealing surface 111 to form a tamper-evident bond and/or leak-tight seal with the container 104. In one presently preferred embodiment, the second heat-sealable layer 220 is a 0.0254-millimeter-thick layer of polyethyleneterephthalate.

In one presently preferred form, the metallic substrate layer 200 is a 0.0508-millimeter-thick layer of an aluminum alloy.

It will be appreciated that in the Figures showing the adhesive layers 213 and 221 with the layers 200, 212 and 220, each adhesive layer is typically a thin film that could be applied to one of the adjacent layers by spraying or roller-coating the adhesive on the adjacent layer. For clarity of illustration, the thicknesses of the layers 200, 212, 213, 220, and 221 have been exaggerated and are not to scale.

The liner 100 may utilize heat-sealable layer materials of any suitable special or conventional type. While the illustrated embodiment of the liner 100 discussed herein is formed from a composite of aluminum, polypropylene, and polyethylene, it will be appreciated that other suitable materials may be used for the heat-sealable layers 212 and 220, based on the composition of the container 104 and closure 106, and the particular application. Although the liner 100 of the present invention is illustrated as including a single metallic substrate layer 200 and first and second heat-sealable layers 212 and 220, respectively, it will be appreciated that additional layers and configurations may be utilized. Furthermore, if the container 104 and closure 108 were made from the same material, then a single material could be used for both the first and second heat-sealable layers 212 and 220.

According to one presently preferred manufacturing process, a laminate of the web layers 200, 212, and 220 and adhesive film layers 213 and 221 can be initially made as a single, composite sheet which can be subsequently stamped or die cut so as to define (1) an annular cut peripheral edge or laterally outer edge 248 (FIG. 7), and (2) an annular cut internal edge that can be characterized as a laterally inward edge 244 (FIG. 7) which includes the inward edge surface 210 (FIG. 8) of the metallic substrate layer 200 as well as the inner edges of the other layers 212, 213, 220, and 221. The resulting shape of the liner 100 is generally annular or ring-shaped to define the liner through hole 252 (FIG. 7) for permitting the contents of the container 104 to be removed therefrom when the liner 100 is disposed between, and sealed to, the closure 106 and the container 104. Although the liner 100 is illustrated as having a generally ring-like shape, it will be appreciated that the liner 100 may have a variety of shapes for accommodating particular shapes of a container closure.

A presently preferred configuration and arrangement of the liner 100 and closure 106 results in the liner through hole 252 being free of any internally projecting structure of the closure 106. For example, neither the valve 160 nor the valve retainer 170 (FIG. 5) projects into the liner through hole 252. Thus, the liner laterally inward edge 244 (FIG. 7)

is less likely to be subject to stress and abrasion or other degradation. Also, the product flow is unobstructed in the through hole 252.

In a typical method of assembling the closure 106 and a container 104 to create a package as illustrated in FIG. 6, the valve peripheral portion 202 is inserted either onto the seat 182 of the retainer 170 or onto the recessed region beneath the base spout 150 of the closure 106. Then the retainer 170 is snapped into the closure base 112 so that the retainer flange 174 is located axially past (i.e., above) the closure base snap bead 176 so as to compress the valve peripheral portion 202 between the retainer valve seat 182 and the underside of the closure base spout 150.

Next, the liner 100 and closure 106 can be mounted on the container 104, and the closure 106 is threadingly installed on the container 104 so as to mechanically clamp the liner 100 between the two package components. Specifically, the closure sealing surface on the top of the first heat-sealable layer 212 of the liner 100 confronts the sealing surface 151 of the closure 106, while the container sealing surface on the bottom of the second heat-sealable layer 220 confronts the container upper end sealing surface 111. In some applications (not illustrated) the closure can be provided with one or more internal retention beads (not illustrated), and the liner can be sized so that its outer periphery engages such a bead to loosely hold the liner in the closure while the assembly of closure and liner is shipped to a bottler (filler) which installs the assembly of the closure and liner on the container. Although not illustrated, the liner could alternatively be provided on its circumference with a plurality of radially outwardly projecting tabs to engage an upwardly facing surface of the closure thread (e.g., thread 132 in FIG. 4) to loosely retain the liner in the closure while it is shipped to a bottler for installation on a container.

Lastly, a heat seal (i.e., a thermal bond) is created by induction heating to bond the container sealing surface of the liner layer 220 to the upper end sealing surface 111 of the container 104, and also bond the closure sealing surface of the liner layer 212 to the sealing surface 151 of the closure 106. In one presently preferred method of installation, the bonding is sufficiently strong such that the torque required to initially effect relative rotation between the closure 106 and the container 104 for destroying the heat-sealed installation and permit removal of the closure 106 is greater than 75 inch-pounds (8.47 Newton-meters) (e.g., even as high as in the range of 100-140 inch-pounds (11.3-15.8 Newton-meters) or more).

The container 104 may be filled with contents (i.e., the product) prior to the installation of the closure 106 onto the container 104, or after closure installation (by opening the closure and filling through the opened closure with a suitable nozzle or cannula).

Typically, a closure manufacturer would make or provide several of the package components (e.g., the closure 106, the valve 160, the retainer 170, and the liner 100—but usually not the container 104), then assemble some or all of those components, and then ship the assembly or components to a bottler for installation on a filled container 104.

Alternatively, depending on the manufacturing capability of the bottler, some of the steps of assembling the closure components could be performed by the bottler instead of the closure manufacturer. For example, the closure 106, the valve 160, the retainer 170, and the liner 100 may be shipped by the closure manufacturer to a bottler as separate, unassembled components, and then the bottler can assemble the closure components, fill the container, and subsequently install the assembled closure components on the container 104.

A method of dispensing product from a package will next be described. A user typically first grasps the package and applies a force to the closure lid lift 164 with a thumb or finger to rotate the closure lid 116 from a closed position to an open position exposing the base spout 150. The lid 116 must be rotated sufficiently away from the valve 160 such that the spud 158 will not interfere with the movement of the head of the valve 160 and will not interfere with the flow of the product during dispensing of the product. The user then typically inverts the package and squeezes, or otherwise deflects, the walls of the container 104 inwardly to pressurize the interior of the container 104 and create a pressure differential across the valve 160 (i.e., the difference between (1) the pressure on the valve's interior surface (facing the interior of the container 104) and (2) the pressure on the valve exterior surface (facing the ambient, external environment)). The greater pressure on the interior surface of the valve 160 causes the valve sleeve 198 to move axially outwardly to force the valve head 190 axially outwardly toward the open valve configuration where the petals, defined between the slits 194, open outwardly to accommodate dispensing of the product. When the user releases the squeezing force on the container 104, the pressure in the container interior will equalize with that of the ambient environment, and the resilient, flexible valve 160 will return to its as-molded, unpressurized closed condition.

It will be appreciated that the container 104 need not have flexible walls, and that other means for pressurizing the container interior may be employed, such as through hydraulic force, gas injection, or mechanical force such as would be the case if the container 104 were part of a dispensing machine or system.

Figure 9:
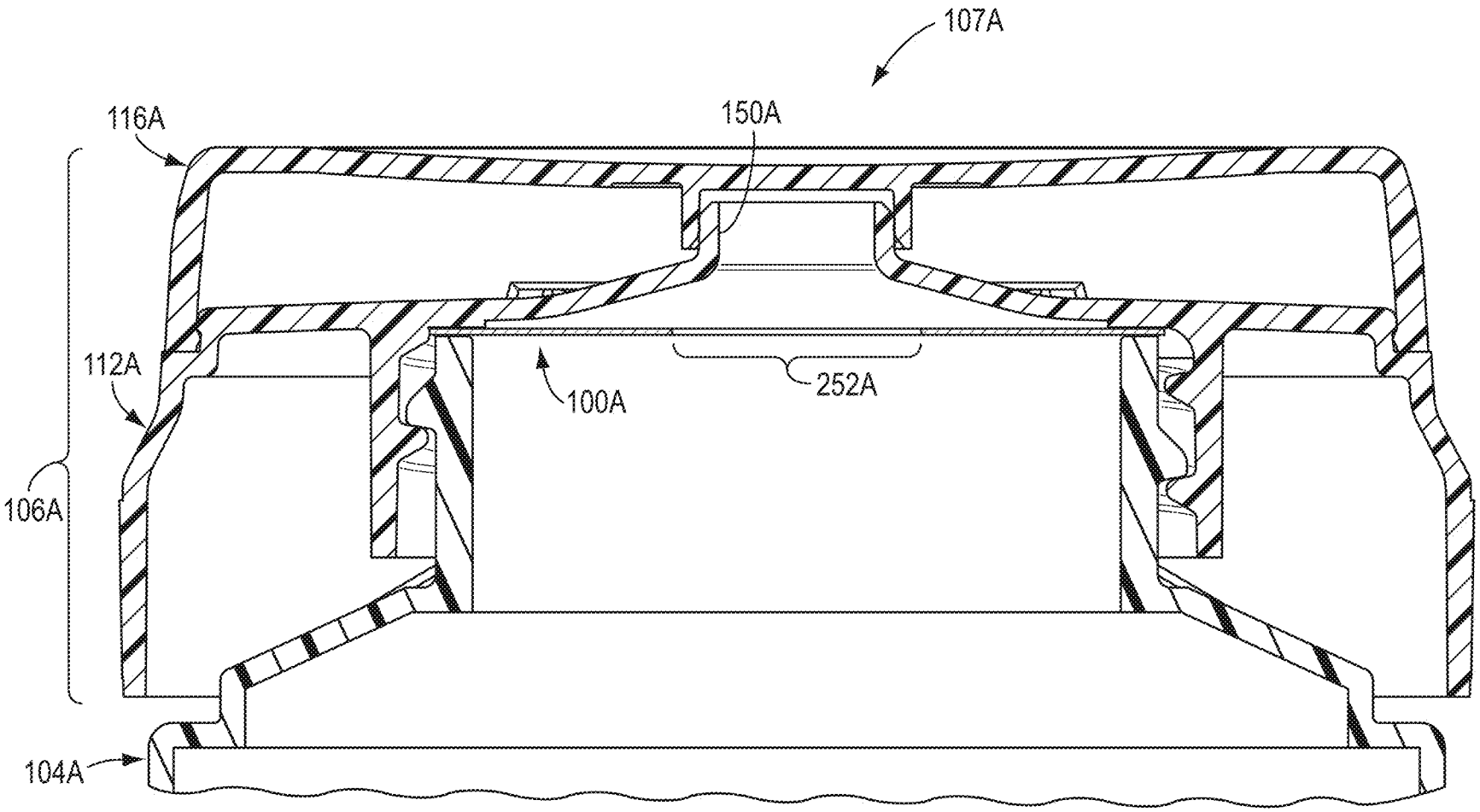
FIG. 9 is a fragmentary, cross-sectional view similar to FIG. 5, but FIG. 9 illustrates an alternate embodiment of closure with a liner on a container.

FIG. 9 illustrates another embodiment of the present invention package as generally identified with reference number 107A. The package 107A includes a container 104A containing a product (not visible in FIG. 9). A closure 106A is installed on the container 104A by heat sealing with a liner 100A having the same composition and configuration as the first embodiment liner 100 described above with reference to FIGS. 1-8.

The closure 106A includes a base 112A having a generally cylindrical spout 150A which can be selectively exposed or occluded by movement of a lid 116A. Unlike in the first embodiment of the closure 107, the second embodiment of the closure 107A does not include a valve (such as the valve 160 in FIGS. 3 and 5.)

The liner 100A has a circular through hole 252A which has a diameter which is somewhat greater than the diameter of the spout 150A, and the liner through hole 252A is coaxial with the spout 150A. The interior of the closure 107A does not have any downward projections or other structure projecting into the liner through hole 252A. Thus, the inward edge of the liner through hole 252 is less likely to be subject to stress and abrasion or other degradation. Further, the flow of product from the container 104A through the hole 252A is not obstructed as it passes through the hole 252A.

The inventors of the present invention have found that when some prior art closures with liners having a metal layer or component (e.g., aluminum) are installed on a container that contains a corrosive product (e.g., an acidic or salty product (e.g., ketchup, salad dressing, etc.)), the exposed metallic liner inward edge surface may contact and react with the product such that an undesirable oxidation or other corrosion reaction may occur over time, and that may produce an undesirable change in the product (e.g., discoloration, taste changes, etc.) and/or unsightly corrosion by-product deposition in the product which may be visible when the product is dispensed and/or which may accumulate on portions of the liner or closure and which could be visible if the closure were to be forcefully removed from the package. In some cases, a corrosion chemical reaction may occur which dissolves, or otherwise creates holes in, part of the metallic substrate layer when the package is stored. The inventors have found a way to eliminate, or at least reduce, the above-described undesirable effects during storage and use of the package.

Accordingly, to one aspect of the invention, the metallic substrate layer 200 is provided as an aluminum alloy having sufficient resistance to oxidation or other corrosion during the design shelf life of the package such that some or all of the above-described undesirable effects do not occur, or occur to only such a minimum extent that they are not noticed by the user.

Figure 10:
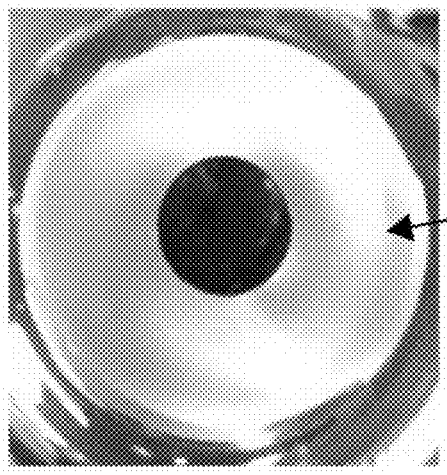
FIGS. 10, 11, and 12 are photographs of test specimens of liners.
Figure 11:
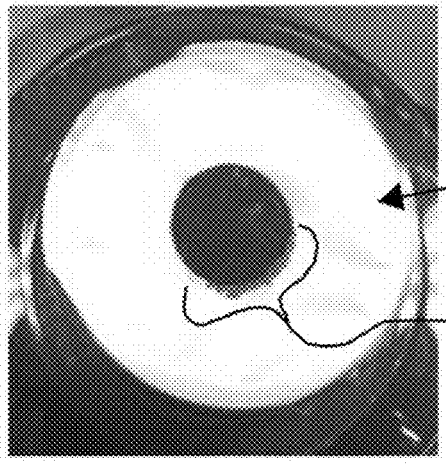
Figure 12:
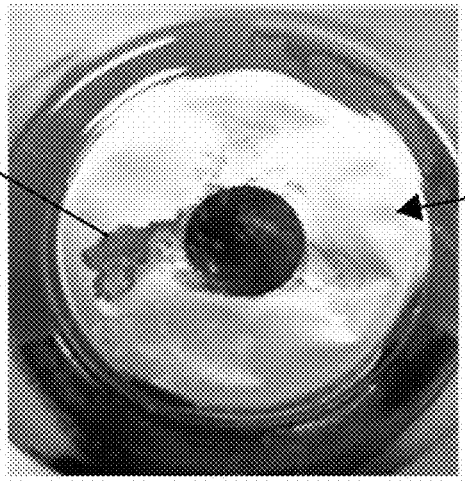

FIGS. 10, 11, and 12 illustrate test sample specimens of various liners which have been subjected to prolonged exposure to ketchup as discussed below in detail.

FIG. 10 illustrates a specimen liner 100B according to one aspect of the present invention. The specimen liner 100B defines a visual "standard" representing an absence of observed corrosion on the aluminum alloy substrate top surface (analogous to the top surface of the aluminum alloy substrate layer 200 described above with reference to FIGS. 6, 7, and 8). The top surface of the aluminum alloy is visible through the overlying, transparent polypropylene first heat-sealable layer (e.g., layer 212 in FIGS. 6, 7, and 8).

The absence of corrosion may be characterized specifically with reference to an aluminum alloy wherein the aluminum alloy, to the naked eye, exhibit substantially no visible corrosion on the top surface of the liner metallic substrate layer 200 comprising the aluminum alloy.

The specimen liner 100B shown in FIG. 10 was tested according to the following procedure as next described.

The liner 100B was made according to the design illustrated in FIGS. 6-8 for the liner 100. The liner 100B had an outside diameter of about 3.1 centimeters (i.e., at the laterally outer edge 248 in FIG. 7), an inside diameter of about 1.0 centimeters (i.e., at the laterally inward edge 244 in FIG. 7). The liner metallic substrate layer (e.g., layer 200 in FIGS. 5, 7, and 8) was an aluminum alloy about 0.05 millimeters thick. The first heat-sealable layer (e.g., layer 212 in FIGS. 7 and 8) was 0.0254 millimeters thick polypropylene) adhered to the top surface of the aluminum alloy substrate layer (e.g., layer 200 in FIGS. 7 and 8) with adhesive, and the second heat-sealable layer (e.g., layer 220 in FIGS. 7 and 8) was 0.0254 millimeters thick polyethylene terephthalate adhered to the bottom surface of the aluminum alloy substrate layer (e.g., layer 200 in FIGS. 7 and 8) with adhesive. The liner 100B had a weight of about 0.2 grams.

The liner 100B was installed with a closure (similar to closures 106 and 106A in FIGS. 5 and 9, respectively) on a container (e.g., container 104 or 104A in FIGS. 5 and 9, respectively) that was filled with ketchup having a pH of about 4 and a sodium concentration of about 1% by weight. The closure was threaded onto the container to clamp the liner against the top of the container. Only the liner's second heat-sealable layer (e.g., bottom layer 220 in FIGS. 4, 6, 7, and 8) was heat-sealed to the top of the container. In order to permit subsequent inspection of the test specimen liner, the first heat-sealable layer (e.g., top layer 212 in FIGS. 4, 6, 7, and 8) was not heat-sealed to the closure (e.g., closure 104 or 104A in FIGS. 5 and 9, respectively). The heat-sealing of the test specimen liner to only the top of the container was achieved with conventional induction heat sealing equipment—but a thermal barrier was interposed between the top of the liner and closure before the closure was threaded onto the container to clamp the liner against the top of the container. The thermal barrier was sufficiently insulating to prevent the top of the liner from being heat-sealed to the closure. Thus, after the test period, as described below, the closure could be unscrewed to permit visual inspection of the top of the liner on the container.

The closed package was inverted so that the closure was oriented at the bottom. In such an orientation, the ketchup in the container would completely coat (i.e., contact) the liner's entire inward edge (e.g., edge 244 in FIG. 7)—including the exposed inward edge surface (e.g., edge surface 210 in FIGS. 7 and 9) of the metallic aluminum alloy substrate layer (e.g., layer 200 in FIGS. 6-9).

The inverted package was maintained in a conditioning chamber for at least 5 months at a temperature of 36.7 degrees Celsius and a relative humidity of 50%.

A number of such tests were conducted with various types of aluminum as the metallic substrate layer and with various closures and containers that did not interfere with, or project into, the liner through hole (e.g., hole 252 in FIGS. 5 and 7). Thus, during the test, the liner through hole aluminum layer's exposed inward edge surface (e.g., edge surface 210 in FIGS. 7 and 8) was always in contact with, and submerged within, the ketchup in the inverted container.

After the 5-month or longer test period, the closure was removed from the package to permit inspection of the liner for corrosion and the deposition of corrosion by-products (e.g., aluminum oxide).

FIG. 10 shows a test specimen liner 100B of the present invention after the inverted package was returned to its upright orientation and after the closure was removed. The specimen liner 100B in FIG. 10 is shown still heat-sealed to the underlying container. The top annular surface of the aluminum substrate layer is visible through the overlying, transparent, first heat-sealable layer of polypropylene (e.g., layer 212 in FIGS. 6-8). FIG. 10 shows no visible corrosion (e.g., dissolved holes or recesses and/or corrosion by-products (e.g., black aluminum oxide)) in or on the top surface of the aluminum alloy visible layer under the transparent polypropylene heat-sealable layer for the test specimen liner 100B which was tested for a test period of at least 5 months.

FIG. 11 shows a different specimen of a post-test liner 100C having a type of aluminum substrate layer which is different than the type of aluminum substrate layer in the FIG. 10 specimen liner 100B and which exhibits some corrosion 300C (e.g., dissolved voids or holes and/or black aluminum oxide) in the annular top surface of the aluminum substrate layer adjacent the annular, exposed inward edge. The amount of corrosion is about 0.1% of the annular area of the top surface of the liner aluminum substrate layer which is visible under the transparent polypropylene layer.

FIG. 12 shows a different specimen of a post-test liner 100D having a type of aluminum substrate layer which is also different than the type of aluminum substrate layer in the FIG. 10 specimen liner 100B and which exhibits substantial corrosion 300D (e.g., dissolved areas (e.g., voids or holes) and/or deposited corrosion by-products) in the top surface of the aluminum substrate layer under the transparent polypropylene layer.

According to one aspect of the invention, a liner exhibiting no visible corrosion on the aluminum alloy substrate layer top surface (pursuant to the above-described test for the liner 100B illustrated in FIG. 10) can be effective in some packages (e.g., package 107 in FIG. 1) to eliminate or minimize undesirable corrosion or corrosion reaction by-products and/or changes (e.g., appearance, taste, etc.) to certain products packaged within the container so that the amount, if any, of such corrosion and/or changes are insufficient to be noticeable or objectionable to the user over the useful life of the package.

In some cases, for some packages of some products, use of a liner having an aluminum alloy substrate that exhibits top surface area corrosion no greater than that exhibited by the above-described test specimen liner 100C (FIG. 11) may also be acceptable.

It will be readily apparent from the foregoing detailed description of the invention and from the illustrations thereof that numerous variations and modifications may be effected without departing from the true spirit and scope of the novel concepts or principles of this invention.

What is claimed is:

1. A package (107, 107A) comprising:

(A) a container (104, 104A) having
  (1) an interior and an opening (108) to said container interior, and
  (2) a sealing surface (111) around said opening (108) to said container interior;

(B) a product stored in said container interior;

(C) a closure (106, 106A) that is mounted on said container (104) over said container opening (108), said closure (106) having
  (1) an occludable access passage (148) for preventing or permitting communication between the container interior and exterior, and
  (2) a sealing surface (151) around said access passage (148); and (D) a liner (100, 100A) disposed at said container opening (108) between said closure (106) and said container (104), said liner (100) having
  (1) a through hole (252) to accommodate communication through said access passage (148) between said interior and exterior of said container (104),
  (2) a metallic substrate layer (200) having
    (a) top and bottom surfaces,
    (b) a laterally inward edge surface (210) that extends between said metallic substrate layer top and bottom surfaces and that is exposed at said liner through hole (252),
    (c) a composition comprising an aluminum alloy wherein said aluminum alloy to the naked eye exhibits substantially no visible corrosion on said top surface after exposure of said laterally inward edge surface (210) for five months to ketchup initially having a pH of about 4 and a sodium concentration of about 1% by weight at a temperature of 36.7 degrees Celsius,
  (3) a first heat-sealable layer (212) that
    (a) is attached to said top surface of said metallic substrate layer (200), and
    (b) has a closure sealing surface heat-sealed to said sealing surface (151) of said closure (106), and
  (4) a second heat-sealable layer (220) that
    (a) is attached to said bottom surface of said metallic substrate layer (200), and
    (b) has a container sealing surface heat-sealed to said sealing surface (111) of said container (104).

2. A package (107, 107A) comprising:

(A) a container (104, 104A) having
  (1) an interior and an opening (108) to said container interior, and
  (2) a sealing surface (111) around said opening (108) to said container interior;

(B) a product stored in said container interior;

(C) a closure (106, 106A) that is mounted on said container (104) over said container opening (108), said closure (106) having
  (1) an occludable access passage (148) for preventing or permitting communication between the container interior and exterior, and
  (2) a sealing surface (151) around said access passage (148); and (D) a liner (100, 100A) disposed at said container opening (108) between said closure (106) and said container (104), said liner (100) having
  (1) a through hole (252) to accommodate communication through said access passage (148) between said interior and exterior of said container (104),
  (2) a metallic substrate layer (200) having
    (a) top and bottom surfaces,
    (b) a laterally inward edge surface (210) that extends between said metallic substrate layer top and bottom surfaces and that is exposed at said liner through hole (252),
    (c) a composition comprising an aluminum alloy wherein said aluminum alloy to the naked eye exhibits substantially no visible corrosion on said top surface after exposure of said laterally inward edge surface (210) for five months to ketchup initially having a pH of about 4 and a sodium concentration of about 1% by weight at a temperature of 36.7 degrees Celsius,
  (3) a first heat-sealable layer (212) that
    (a) is attached to said top surface of said metallic substrate layer (200), and
    (b) has a closure sealing surface heat-sealed to said sealing surface (151) of said closure (106),
  (4) a second heat-sealable layer (220) that
    (a) is attached to said bottom surface of said metallic substrate layer (200), and
    (b) has a container sealing surface heat-sealed to said sealing surface (111) of said container (104), and
  (5) a location relative to said closure (106) and said container (104) such that said through hole (252) is free of any internally projecting structure of said closure (106).

3. A package (107, 107A) comprising:

(A) a container (104, 104A) having
  (1) an interior and an opening (108) to said container interior, and
  (2) a sealing surface (111) around said opening (108) to said container interior;

(B) a product stored in said container interior;

(C) a closure (106, 106A) that is mounted on said container (104) over said container opening (108), said closure (106) having
  (1) an occludable access passage (148) for preventing or permitting communication between the container interior and exterior, and
  (2) a sealing surface (151) around said access passage (148); and (D) a liner (100, 100A) disposed at said container opening (108) between said closure (106) and said container (104), said liner (100) having
  (1) a through hole (252) to accommodate communication through said access passage (148) between said interior and exterior of said container (104), (2) a metallic substrate layer (200) having
(a) top and bottom surfaces,
(b) a laterally inward edge surface (210) that extends between said metallic substrate layer top and bottom surfaces and that is exposed at said liner through hole (252),
(c) a composition comprising an aluminum alloy wherein said aluminum alloy to the naked eye exhibits substantially no visible corrosion on said top surface after exposure of said laterally inward edge surface (210) for five months to ketchup initially having a pH of about 4 and a sodium concentration of about 1% by weight at a temperature of 36.7 degrees Celsius,
(3) a first heat-sealable layer (212) that
(a) is attached to said top surface of said metallic substrate layer (200), and
(b) has a closure sealing surface heat-sealed to said sealing surface (151) of said closure (106), and
(4) a second heat-sealable layer (220) that
(a) is attached to said bottom surface of said metallic substrate layer (200), and
(b) has a container sealing surface heat-sealed to said sealing surface (111) of said container (104) wherein each said first heat-sealable layer (212) and said second heat-sealable layer (220) is heat-sealed to create a bond which is sufficiently strong such that a torque greater than 8.47 Newton-meters is required to initially effect relative rotation between said closure (106) and said container (104) for destroying the heat-sealed installation and permit removal of said closure (106).

4. A package (107, 107A) comprising:
(A) a container (104, 104A) having
(1) an interior and an opening (108) to said container interior, and
(2) a sealing surface (111) around said opening (108) to said container interior;
(B) a product stored in said container interior;
(C) a closure (106, 106A) that is mounted on said container (104) over said container opening (108), said closure (106) having
(1) an occludable access passage (148) for preventing or permitting communication between the container interior and exterior, and
(2) a sealing surface (151) around said access passage (148); and
(D) a liner (100, 100A) disposed at said container opening (108) between said closure (106) and said container (104), said liner (100) having
(1) a through hole (252) to accommodate communication through said access passage (148) between said interior and exterior of said container (104),
(2) a metallic substrate layer (200) having
(a) top and bottom surfaces,
(b) a laterally inward edge surface (210) that extends between said metallic substrate layer top and bottom surfaces and that is exposed at said liner through hole (252),
(c) a composition comprising an aluminum alloy wherein said aluminum alloy to the naked eye exhibits substantially no visible corrosion on said top surface after exposure of said laterally inward edge surface (210) for five months to a product initially having a pH of about 4 at a temperature of 36.7 degrees Celsius,
(3) a first heat-sealable layer (212) that
(a) is attached to said top surface of said metallic substrate layer (200), and
(b) has a closure sealing surface heat-sealed to said sealing surface (151) of said closure (106), and
(4) a second heat-sealable layer (220) that
(a) is attached to said bottom surface of said metallic substrate layer (200), and
(b) has a container sealing surface heat-sealed to said sealing surface (111) of said container (104).

5. A package (107, 107A) comprising:
(A) a container (104, 104A) having
(1) an interior and an opening (108) to said container interior, and
(2) a sealing surface (111) around said opening (108) to said container interior;
(B) a product stored in said container interior;
(C) a closure (106, 106A) that is mounted on said container (104) over said container opening (108), said closure (106) having
(1) an occludable access passage (148) for preventing or permitting communication between the container interior and exterior, and
(2) a sealing surface (151) around said access passage (148); and
(D) a liner (100, 100A) disposed at said container opening (108) between said closure (106) and said container (104), said liner (100) having
(1) a through hole (252) to accommodate communication through said access passage (148) between said interior and exterior of said container (104),
(2) a metallic substrate layer (200) having
(a) top and bottom surfaces,
(b) a laterally inward edge surface (210) that extends between said metallic substrate layer top and bottom surfaces and that is exposed at said liner through hole (252),
(c) a composition comprising an aluminum alloy wherein said aluminum alloy to the naked eye exhibits substantially no visible corrosion in excess of about 0.1% of the area of said top surface after exposure of said laterally inward edge surface (210) for five months to a product initially having a pH of about 4 at a temperature of 36.7 degrees Celsius,
(3) a first heat-sealable layer (212) that
(a) is attached to said top surface of said metallic substrate layer (200), and
(b) has a closure sealing surface heat-sealed to said sealing surface (151) of said closure (106), and
(4) a second heat-sealable layer (220) that
(a) is attached to said bottom surface of said metallic substrate layer (200), and
(b) has a container sealing surface heat-sealed to said sealing surface (111) of said container (104).

6. The package (107, 107A) in accordance with claim 1 in which one of said heat-sealable layers (212, 220) is about 0.025 millimeters thick.

7. The package (107, 107A) in accordance with claim 1 in which each of said heat-sealable layers (212, 220) is about 0.025 millimeters thick.

8. The package (107, 107A) in accordance with claim 1 in which at least one of said first heat-sealable layer (212) and said second heat-sealable layer (220) is formed from a plurality of thinner layers.

9. The package (107, 107A) in accordance with claim 1 in which said first heat-sealable layer (212) and said second heat-sealable layer (220) are each formed from a different material.

10. The package (107, 107A) in accordance with claim 1 in which said metallic substrate layer (200) is about 0.05 millimeters thick.

11. The package (107, 107A) in accordance with claim 1 in which:

(i) one of said first heat-sealable layer (212) and said second heat-sealable layer (220) is formed from polyethylene terephthalate; and (ii) the other of said first heat-sealable layer (212) and said second heat-sealable layer (220) is formed from polypropylene.

12. A liner (100, 100A) for use in a package (107, 107A) wherein said package (107, 107A) includes:

(A) a container (104, 104A) having (1) an interior and an opening (108) to said container interior, and (2) a sealing surface (111) around said opening (108) to said container interior;

(B) a product stored in said container interior;

(C) a closure (106, 106A) that is mounted on said container (104) over said container opening (108), said closure (106) having (1) an occludable access passage (148) for preventing or permitting communication between the container interior and exterior, and (2) a sealing surface (151) around said access passage (148); and wherein said package (107) has said liner (100) disposed at said container opening (108) between said closure (106) and said container 104);

said liner (100, 100A), prior to installation in said package (107), comprising:

(1) a configuration that defines a through hole (252) that can accommodate communication through said access passage (148) between said interior and exterior of said container (104) when said liner (100) is subsequently installed in said package (107), (2) a metallic substrate layer (200) having (a) top and bottom surfaces, (b) a laterally inward edge surface (210) that extends between said metallic substrate layer top and bottom surfaces and that is exposed at said liner through hole (252), (c) a composition comprising an aluminum alloy wherein said aluminum alloy to the naked eye exhibits substantially no visible corrosion on said top surface after exposure of said laterally inward edge surface (210) for five months to a product initially having a pH of about 4 at a temperature of 36.7 degrees Celsius, (3) a first heat-sealable layer (212) that (a) is attached to said top surface of said metallic substrate layer (200), and (b) has a closure sealing surface that can be heat-sealed to said sealing surface (151) of said closure (106), and (4) a second heat-sealable layer (220) that (a) is attached to said bottom surface of said metallic substrate layer (200), and (b) has a container sealing surface that can be heat-sealed to said sealing surface (111) of said container (104).

13. A liner (100, 100A) for use in a package (107, 107A) wherein said package (107, 107A) includes:

(A) a container (104, 104A) having (1) an interior and an opening (108) to said container interior, and (2) a sealing surface (111) around said opening (108) to said container interior;

(B) a product stored in said container interior;

(C) a closure (106, 106A) that is mounted on said container (104) over said container opening (108), said closure (106) having (1) an occludable access passage (148) for preventing or permitting communication between the container interior and exterior, and (2) a sealing surface (151) around said access passage (148); and wherein said package (107) has said liner (100) disposed at said container opening (108) between said closure (106) and said container (104);

said liner (100, 100A), prior to installation in said package (107), comprising:

(1) a configuration that defines a through hole (252) that can accommodate communication through said access passage (148) between said interior and exterior of said container (104) when said liner (100) is subsequently installed in said package (107), (2) a metallic substrate layer (200) having (a) top and bottom surfaces, (b) a laterally inward edge surface (210) that extends between said metallic substrate layer top and bottom surfaces and that is exposed at said liner through hole (252), (c) a composition comprising an aluminum alloy wherein said aluminum alloy to the naked eye exhibits substantially no visible corrosion in excess of about 0.1% of the area of said top surface after exposure of said laterally inward edge surface (210) for five months to a product initially having a pH of about 4 at a temperature of 36.7 degrees Celsius, (3) a first heat-sealable layer (212) that (a) is attached to said top surface of said metallic substrate layer (200), and (b) has a closure sealing surface that can be heat-sealed to said sealing surface (151) of said closure (106), and (4) a second heat-sealable layer (220) that (a) is attached to said bottom surface of said metallic substrate layer (200), and (b) has a container sealing surface that can be heat-sealed to said sealing surface (111) of said container (104).

14. The liner (100, 100A) in accordance with claim 12 in which one of said heat-sealable layers (212, 220) is about 0.025 millimeters thick.

15. The liner (100, 100A) in accordance with claim 12 in which each of said heat-sealable layers (212, 220) is about 0.025 millimeters thick.

16. The liner (100, 100A) in accordance with claim 12 in which at least one of said first heat-sealable layer (212) and said second heat-sealable layer (220) is formed from a plurality of thinner layers.

17. The liner (100, 100A) in accordance with claim 12 in which said first heat-sealable layer (212) and said second heat-sealable layer (220) are each formed from a different material.

18. The liner (100) in accordance with claim 12 in which said metallic substrate layer (200) is about 0.05 millimeters thick.

19. The liner (100, 100A) in accordance with claim 12 in which:

(i) one of said first heat-sealable layer (212) and said second heat-sealable layer (220) is formed from polyethylene terephthalate; and (ii) the other of said first heat-sealable layer (212) and said second heat-sealable layer (220) is formed from polypropylene.

20. The liner (100, 100A) in accordance with claim 12 in which said liner metallic substrate layer composition comprises an aluminum alloy wherein said aluminum alloy to the naked eye exhibits no visible corrosion on said top surface of said liner metallic substrate layer (200) after exposure of said laterally inward edge surface (210) for five months to ketchup initially having a pH of about 4 and a sodium concentration of about 1% by weight at a temperature of 36.7 degrees Celsius.

21. An assembly of a liner (100, 100A) and closure (106, 106A) for subsequent installation as part of a package (107, 107A) wherein said package (107, 107A) includes (A) a container (104, 104A) having (1) an interior and an opening (108) to said container interior, and (2) a sealing surface (111) around said opening (108) to said container interior; (B) a product stored in said container interior; and (C) said assembly; said assembly comprising:

(1) said closure (106) wherein said closure (106) is provided for being mounted on said container (104) over said container opening (108), said closure (106) having (a) an occludable access passage (148) for preventing or permitting communication between the container interior and exterior, and (b) a sealing surface (151) around said access passage (148); and (2) said liner (100) wherein said liner (100) has (a) a periphery that engages said closure (106) so as to retain said liner (100) in said closure (106) prior to installation in said package (107), (b) a through hole (252) that can accommodate communication through said access passage (148), (c) a metallic substrate layer (200) having (i) top and bottom surfaces, (ii) a laterally inward edge surface (210) that extends between said metallic substrate layer top and bottom surfaces and that is exposed at said liner through hole (252), (iii) a composition comprising an aluminum alloy wherein said aluminum alloy to the naked eye exhibits substantially no visible corrosion in excess of about 0.1% of the area of said top surface after exposure of said laterally inward edge surface (210) for five months to a product initially having a pH of about 4 at a temperature of 36.7 degrees Celsius, (d) a first heat-sealable layer (212) that (i) is attached to said top surface of said metallic substrate layer (200), and (ii) has a closure sealing surface that can be heat-sealed to said sealing surface (151) of said closure (106), (e) a second heat-sealable layer (220) that (i) is attached to said bottom surface of said metallic substrate layer (200), and (ii) has a container sealing surface that can be heat-sealed to said sealing surface (111) of said container (104), and (f) a position in said closure (106) that locates said liner through hole (252) in said closure access passage (148) so that said through hole (252) is free of any internally projecting structure of said closure (106).

22. The assembly in accordance with claim 21 in which one of said heat-sealable layers (212, 220) is about 0.025 millimeters thick.

23. The assembly in accordance with claim 21 in which each of said heat-sealable layers (212, 220) is about 0.025 millimeters thick.

24. The assembly in accordance with claim 21 in which at least one of said first heat-sealable layer (212) and said second heat-sealable layer (220) is formed from a plurality of thinner layers.

25. The assembly in accordance with claim 21 in which said first heat-sealable layer (212) and said second heat-sealable layer (220) are each formed from a different material.

26. The assembly in accordance with claim 21 in which said metallic substrate layer (200) is about 0.05 millimeters thick.

27. The assembly in accordance with claim 21 in which:

(i) one of said first heat-sealable layer (212) and said second heat-sealable layer (220) is formed from polyethylene terephthalate; and (ii) the other of said first heat-sealable layer (212) and said second heat-sealable layer (220) is formed from polypropylene.

* * * * *